US009631165B2

(12) United States Patent
Droege et al.

(10) Patent No.: US 9,631,165 B2
(45) Date of Patent: Apr. 25, 2017

(54) STABILIZATION OF CAPSULE SYSTEMS IN LAUNDRY DETERGENTS AND OTHER CLEANING PRODUCTS WITH ONE OR MORE RHEOLOGY MODIFIERS

(71) Applicant: Symrise AG, Holzminden (DE)

(72) Inventors: Joerg Droege, Bodenwerder (DE); Joern Wiedemann, Holzminden (DE)

(73) Assignee: Symrise AG, Holzminden (DE)

( * ) Notice: Subject to any disclaimer, the term of this patent is extended or adjusted under 35 U.S.C. 154(b) by 0 days.

(21) Appl. No.: 14/429,568

(22) PCT Filed: Aug. 7, 2013

(86) PCT No.: PCT/EP2013/066582

§ 371 (c)(1),
(2) Date: Mar. 19, 2015

(87) PCT Pub. No.: WO2014/044461

PCT Pub. Date: Mar. 27, 2014

(65) Prior Publication Data

US 2015/0232791 A1 Aug. 20, 2015

(30) Foreign Application Priority Data

Sep. 19, 2012 (EP) ..... 12184985

(51) Int. Cl.

| | |
|---|---|
| ***C11D 3/08*** | (2006.01) |
| ***C11D 3/50*** | (2006.01) |
| ***C11D 7/14*** | (2006.01) |
| ***C11D 7/50*** | (2006.01) |
| ***C11D 3/20*** | (2006.01) |
| ***C11D 3/37*** | (2006.01) |

(52) U.S. Cl.
CPC ..... *C11D 3/505* (2013.01); *C11D 3/2093* (2013.01); *C11D 3/3757* (2013.01)

(58) Field of Classification Search
CPC .. C11D 3/08; C11D 3/50; C11D 3/502; C11D 3/505; C11D 7/14; C11D 7/265; C11D 7/50; C11D 9/442; C11D 11/0017
See application file for complete search history.

(56) References Cited

U.S. PATENT DOCUMENTS

| | | | | |
|---|---|---|---|---|
| 2003/0190296 | A1* | 10/2003 | Aronson | A61K 8/068 424/59 |
| 2004/0087477 | A1* | 5/2004 | Ness | C11D 3/505 512/4 |
| 2005/0226900 | A1* | 10/2005 | Winton Brooks | A61K 8/11 424/401 |
| 2007/0264293 | A1* | 11/2007 | Elder | A61K 8/11 424/401 |
| 2010/0150975 | A1 | 6/2010 | Dihora et al. | |
| 2011/0263475 | A1* | 10/2011 | Vanpachtenbeke | C11D 3/0015 510/344 |
| 2013/0029895 | A1* | 1/2013 | Bettiol | C11D 3/1266 510/236 |
| 2013/0123162 | A1* | 5/2013 | Souter | C11D 3/386 510/295 |
| 2013/0189196 | A1* | 7/2013 | Tamarkin | A61K 8/046 424/47 |
| 2014/0033448 | A1* | 2/2014 | Panandiker | C08G 77/388 8/137 |

FOREIGN PATENT DOCUMENTS

| | | | |
|---|---|---|---|
| EP | 1 502 944 | A1 | 2/2005 |
| WO | 2011/120772 | A1 | 10/2011 |

* cited by examiner

*Primary Examiner* — Charles Boyer
(74) *Attorney, Agent, or Firm* — Dilworth & Barrese, LLP

(57) ABSTRACT

The invention relates to stabilization systems for capsules in washing and cleaning compositions, wherein the capsules contain active ingredients or other ingredients and have an average particle size distribution from 0.1 nm to 1000 μm.

16 Claims, 1 Drawing Sheet

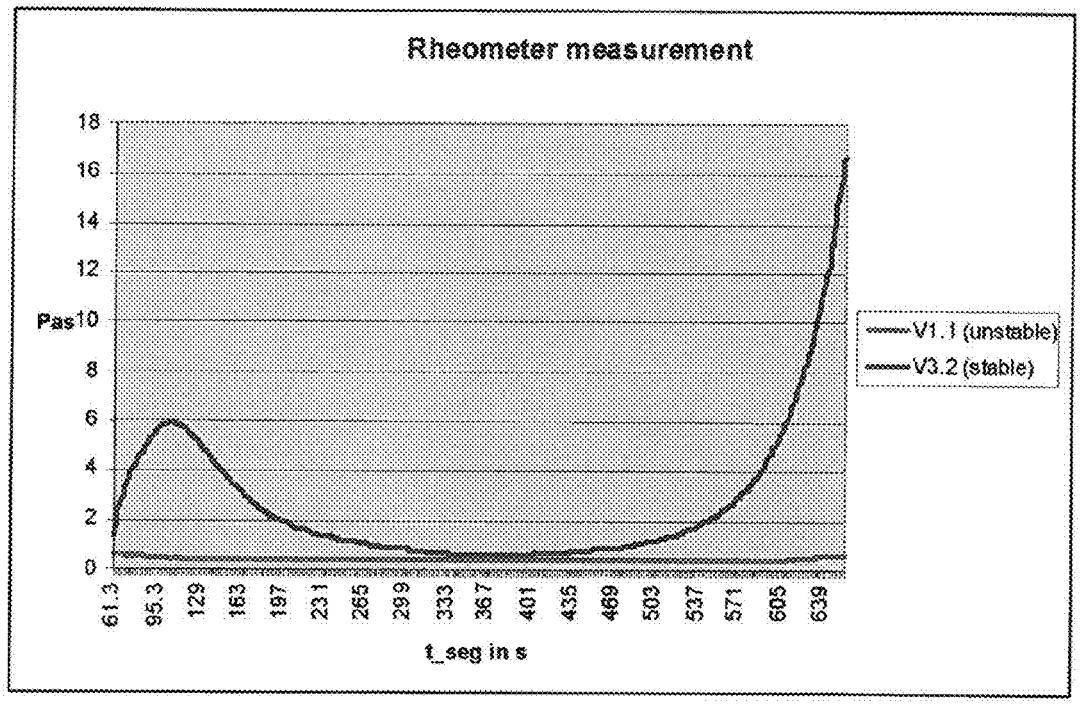
Rheometer measurement

STABILIZATION OF CAPSULE SYSTEMS IN LAUNDRY DETERGENTS AND OTHER CLEANING PRODUCTS WITH ONE OR MORE RHEOLOGY MODIFIERS

FIELD OF THE INVENTION

The invention relates to stabilization systems for capsules in washing and cleaning compositions, wherein the capsules contain active ingredients or other ingredients and have an average particle size distribution from 0.1 nm to 1000 μm.

STATE OF THE ART

The incorporation of particular active ingredients (for example bleaches, enzymes, perfumes, dyes, etc.) into liquid washing and cleaning compositions can lead to problems. For example, incompatibilities between the individual active ingredient components of the liquid washing and cleaning compositions can occur. This can lead to unwanted discolouration, agglomeration, odour problems and breakdown of washing-active ingredients. However, the consumer expects liquid washing and cleaning compositions which display optimal action at the time of the use even after storage and transport. This means that the ingredients of the liquid washing and cleaning composition have not settled out, broken down or evaporated off beforehand.

One way of incorporating sensitive, chemically or physically incompatible and volatile components involves using capsules and especially microcapsules, in which these ingredients are incorporated in a storage- and transport-stable manner. For example, washing and cleaning compositions may comprise, for example, the following active ingredients and other ingredients which can be encapsulated: conditioning agents, fragrances, pH modifiers, fluorescers, dyes, hydrotropes, silicone oils, antiredeposition agents, optical brighteners, greying inhibitors, anti-crease agents, active antimicrobial ingredients, germicides, fungicides, antioxidants, antistats, ironing aids, hydrophobizing and impregnating agents, bleaches, acidifiers and UV absorbers, to name just a few. The stabilization of the capsules in formulations is often a challenge.

Fragrances, for example, are an essential constituent in the formulation for the washing and cleaning compositions sector. Thus, laundry is to have a pleasant and fresh fragrance both in the wet and in the dry state. It is therefore necessary that fragrances have good affinity for the fibres and continue to adhere thereto, in order subsequently to release the fragrances again in a retarded manner, in order that the laundry releases a pleasant fragrance note over a prolonged period. The demands on fragrances are accordingly set quite high. The basic problem in the use of fragrances is that fragrances are volatile substances. However, the effect of this property in turn is their fragrance effect. Therefore, the use of fragrances in textile and surface treatment compositions involves facing the challenge of stabilizing these volatile fragrances for long enough, such that they do not all evaporate within a very short time and do not give any fragrance effect any longer. The fragrances should evaporate off within a particular period after the cleaning and in doing so bring about a long-lasting and very homogeneous odour effect. A problem with fragrances is the fact that the fragrance impression of a perfume changes over the course of time because the odourants which constitute the fresh and light notes in the perfume evaporate off more quickly because of their high vapour pressure than the fragrances which constitute the heart and base notes. Therefore, fragrances are often encapsulated in order thus to be able to stabilize the odour impression over a prolonged period. However, this leads to the problem that the capsules comprising such fragrances, but also other ingredients customary for washing and cleaning compositions, generally after prolonged standing, sediment or rise to the top and hence destroy the stability of the formulation.

WO 2011 031940 A1 describes an external structuring system (ESS) for stabilization of aqueous washing and cleaning compositions. This ESS comprises glyceride crystals, preferably of hydrogenated castor oils, alkanolamines and anions which originate from anionic surfactants.

From the cosmetics sector, British patent specification GB 1 471 406 B describes liquid aqueous cleansing compositions containing at least 2% by weight of triethanolamine laurylsulphate, a total of 8% to 50% by weight of surfactant and 0.1% to 5% by weight of suspended phase, for example spheroidal capsules having a diameter of 0.1 to 5 mm, and having a pH of 5.5 to 11. Homogeneous distribution of the suspended phase is achieved by using water-soluble acrylic acid polymers, for example Carbopol 941.

One way of suspending particles or capsules in a liquid is to use structured liquids. In this context, a distinction is made between internal and external structuring. External structuring can be achieved, for example, by using structuring gums, for example xanthan gum, guar gum, carob seed gum, gellan gum, wellan gum or carrageenan, or polyacrylate thickeners.

From an aesthetic point of view, it is desirable that the liquid washing compositions in which the particles are suspended are transparent or at least translucent. However, the use of structuring gums often leads to a turbid composition.

WO 2000/036078 A1 describes transparent/translucent liquid washing compositions capable of suspending particles having a size of 300 to 5000 μm, comprising at least 15% by weight of surfactant and 0.01% to 5% by weight of a polymeric gum.

One disadvantage in the case of use of these structuring agents or thickeners is their sensitivity to ionic compounds, especially to the anionic surfactants that are obligatory in cleaning applications. In the case of high concentrations of polymeric thickeners in systems having simultaneously high concentrations of anionic surfactants, there may be significant rises in viscosity which greatly impair the handling of the washing and cleaning compositions (for example pumping, pouring or dosing).

The problem addressed by the present invention was that of developing and providing a stabilization system for capsules containing active ingredients and other ingredients in formulations, such as in washing and cleaning compositions.

This stabilization system is not just to assure good storage stability of the formulation but also to build up a network in the formulation such that the capsules containing the active ingredients and other ingredients are kept suspended, such that they do not sediment or rise up in the formulation. A further problem was that of providing a stabilization system which can be temporarily eliminated by slight mechanical action and is built up again after a very short time as soon as the formulation is at rest again. This assures easy dosage without destabilizing the formulation, and rapid re-stabilization of the capsules in the formulation as soon as the mechanical action has been stopped.

Surprisingly, compositions suitable as stabilization systems for such capsules in washing and cleaning compositions have been found. The stabilization systems of the present invention are especially suitable for capsules having an average particle size distribution from 0.1 nm to 1 mm. A stabilization system according to the invention comprises at least one rheology modifier selected from the group consisting of hydrogenated castor oils, hydrogenated castor waxes, polyacrylates, sheet silicates and mixtures thereof.

DESCRIPTION OF THE INVENTION

The present invention provides stabilization systems for capsules in washing and cleaning compositions containing active ingredients and other ingredients, wherein the capsules have an average particle size distribution from 0.1 nm to 1 mm. The stabilization systems according to the invention comprise at least one rheology modifier selected from the group consisting of hydrogenated castor oils, hydrogenated castor waxes, polyacrylates, sheet silicates and mixtures thereof. Preferred polyacrylates are latex polyacrylates, anionic polyacrylate emulsions, polyacrylate dispersions and polymers of the ASE type or polymers of the HASE type.

The core of the capsules preferably comprises active ingredients and other ingredients for care, conditioning and/or aftertreatment of textiles and preferably includes substances selected from the group consisting of fragrances, builders, bleaches, bleach activators, enzymes, greying inhibitors, foam inhibitors, inorganic salts, solvents, pH modifiers, fluorescers, dyes, hydrotropes, silicone oils, soil release compounds, optical brighteners, anti-crease agents, dye transfer inhibitors, active antimicrobial ingredients, germicides, fungicides, antioxidants, corrosion inhibitors, antistats, anti-swell and anti-slip agents, UV absorbers, acidifiers.

In a preferred embodiment, the capsules have an average particle size distribution from 0.1 nm to 1000 μm, preferably 1 μm to 100 μm, more preferably 5 μm to 75 μm, most preferably 10 μm to 50 μm. These capsules can be stabilized particularly efficiently in washing and cleaning compositions by the stabilization systems according to the invention.

According to the invention, a washing and cleaning composition contains a stabilization system for capsules comprising at least one rheology modifier selected from the group consisting of hydrogenated castor oils, hydrogenated castor waxes, polyacrylates, sheet silicates and mixtures thereof.

Rheology Modifiers

Preference is given to using, as rheology modifiers, castor waxes having a melting point range of 60 to 85° C., an acid number of 2 to 4, and a hydrolysis number of 175 to 185 and an iodine number of about 4.

Preferred castor oils which are used as rheology modifiers have a hydrolysis number of 186 to 203, a hydroxyl number of 160 to 168 and an iodine number of 81 to 100. Preferably, the castor oil consists of a mixture of a plurality of compounds in a mixture of individual compounds of the following composition: oleic acid from 3.6% to 9% by weight, linoleic acid from 3% to 5% by weight, linolenic acid at about 4% by weight, ricinoleic acid from 77% to 83% by weight, palmitic acid from 0% to 1.6% by weight, stearic acid from 1.5% to 3% by weight and vaccenic acid, arachic acid and eicosanoic acid below 1% by weight. The figures in per cent by weight are based on the overall mixture (castor oil).

Suitable castor waxes or castor oils which can be used as rheology modifiers in the present invention are obtainable under the Thixcin® trade name (INCI: 2,3-bis(12-hydroxyoctadecanoloxy)propyl 12-hydroxyoctadecanoate) from Element's Specialitis and the castor oil or castor wax product line from Acme Hardesty Co. (for example Acme Wax 225, Acme Wax 224, Acme Wax TGA etc.).

Suitable polyacrylates are, for example, the high molecular weight homopolymers of acrylic acid which have been crosslinked with a polyalkenyl polyether, especially with an allyl ether of sucrose, pentaerythritol or propylene (INCI name according to the International Dictionary of Cosmetic Ingredients from The Cosmetic, Toiletry and Fragrance Association (CTFA): Carbomer), which are also referred to as carboxyvinyl polymers. Polyacrylic acids of this kind are available inter alia from 3V Sigma under the Polygel® trade name, e.g. Polygel®400 and Polygel®301, and from Lubrizol under the Carbopol® trade name, e.g. Carbopol® 940 (molecular weight about 4 000 000), Carbopol® 941 (molecular weight about 1 250 000) or Carbopol® 934 (molecular weight about 3 000 000), Carbopol® Aqua 30 Polymer. Preference is given to Polygel®400 and Polygel®301 and Carbopol® Aqua 30 Polymer.

These also include the following acrylic acid copolymers:

i) Polymers of the HASE type are solubilized hydrophobically modified alkali-soluble polymers. They are preferably aqueous solutions of hydrophobically modified alkali-soluble emulsion polymers. Hydrophobically modified alkali-soluble emulsion ("HASE") polymers are polymers which are typically used to increase the viscosity of aqueous solutions. Such a polymer is typically a copolymer containing an anionic group, a hydrophobic group and a nonionic group. Preferably, HASE polymer compositions are synthesized by emulsion polymerization. Formula I shows an example of how an HASE polymer can be described:

Formula I

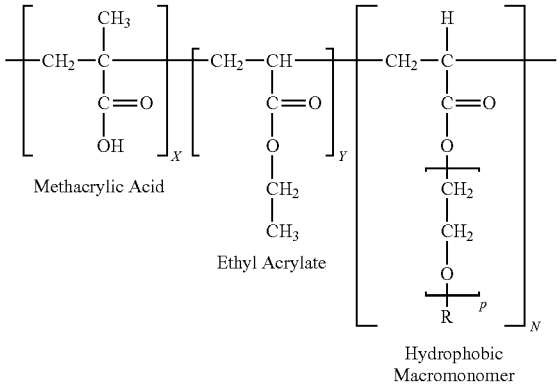

The "methacrylic acid" group is the anionic monomer unit and the "ethyl acrylate" group the nonionic monomer unit. The methyl group and ethyl group in the "methacrylic acid" and "ethyl acrylate" groups from formula I are not restricted to methyl and ethyl for use according to the invention in the stabilization system. Formula I merely shows an illustrative formula for an HASE polymer and has no limiting effect on the HASE polymers used in the present application.

Thus, formula Ia shows a more general formula of an HASE polymer which can likewise be used as a rheology modifier in the present invention:

Formula Ia

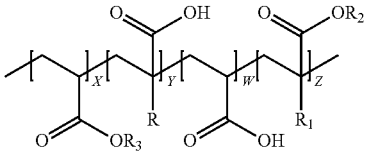

$R_x$ = Acyl chain from 1 to 22 carbons

Suitable nonionic monomers for the production of an HASE polymer composition are monomers which contain no positive or negative charges in aqueous solution and preferably have carbon chains of fewer than 8 carbon units. The amount of nonionic monomer as polymerized units in the HASE polymer is typically 30 to 75 parts by weight, preferably 35 to 70 parts by weight, more preferably 40 to 65 parts by weight. Suitable nonionic monomers include C1 to C7 alkyl and C2 to C7 hydroxyalkyl esters of acrylic acid and methacrylic acid, including ethyl (meth)acrylate, methyl (meth)acrylate, 2-ethylhexyl acrylate, butyl (meth)acrylate, 2-hydroxyethyl acrylate, 2-hydroxybutyl methacrylate, styrene, vinyltoluene, t-butylstyrene, isopropylstyrene and p-chlorostyrene, vinyl acetate, vinyl butyrate, vinyl caproate, acrylonitrile, methacrylonitrile, butadiene, isoprene, vinyl chloride, vinylidene chloride and the like. Preference is given to ethyl (meth)acrylate, methyl (meth)acrylate, 2-ethylhexyl acrylate, butyl (meth)acrylate, 2-hydroxyethyl acrylate and 2-hydroxybutyl methacrylate. Particular preference is given to ethyl acrylate, methyl acrylate and butyl acrylate.

Suitable anionic monomers for the production of an HASE polymer composition are monomers which contain a negative charge when present in a basic aqueous solution. The amount of anionic monomer as polymerized units in the HASE polymer is typically 5 to 75 parts by weight, preferably 10 to 60 parts by weight, more preferably 20 to 50 parts by weight. Suitable anionic monomers include acrylic acid, methacrylic acid, crotonic acid, phosphoethyl methacrylate, 2-acrylamido-2-methyl-1-propanesulphonic acid, sodium vinylsulphonate, itaconic acid, fumaric acid, maleic acid, monomethyl itaconate, monomethyl fumarate, monobutyl fumarate and maleic anhydride. Preference is given to acrylic acid, itaconic acid, 2-acrylamido-2-methyl-1-propanesulphonic acid, fumaric acid and methacrylic acid. Particular preference is given to methacrylic acid, 2-acrylamido-2-methyl-1-propanesulphonic acid and acrylic acid.

Suitable hydrophobic monomers for the production of an HASE polymer composition include surface-active esters such as $C_8$-$C_{30}$-alkylphenoxy(ethyleneoxy)$_{6-100}$-ethyl (meth)acrylates and $C_8$-$C_{30}$-alkoxy(ethyleneoxy)$_{6-50}$-ethyl (meth)acrylates, $C_8$-$C_{30}$-alkylphenoxyethyl (meth)acrylates and $C_8$-$C_{30}$-alkoxyethyl (meth)acrylates. Further compounds, although they are unrestricted, may be ethers, amides and urethanes. Further suitable hydrophobic monomers comprise, for example, vinyl esters of $C_8$-$C_{30}$ carboxylic acids and $C_8$-$C_{30}$-alkyl esters of (methyl)acrylat. The amount of hydrophobic monomer as polymerized units in the HASE polymer is typically 1 to 20 parts by weight, preferably 1 to 15 parts by weight, more preferably 1 to 10 parts by weight. Suitable hydrophobic monomers include $C_{18}H_{37}(EO)_{20}$ (meth)acrylate and $C_{20}H_{25}(EO)_{23}$ (meth)acrylate. Preference is given to $C_{18}H_{37}(EO)_{20}$ methacrylate and $C_{20}H_{25}(EO)_{23}$ methacrylate.

Suitable HASE polymer compositions which can be used as rheology modifiers in the present invention are available under the Polygel® trade name from Neochem (Polygel W30 (INCI: Acrylate/Palmeth-25-Acrylate Copolymer), Polygel W301) and under the Novethix™ L-10 Polymer trade name from Lubrizol and under the ACULYN™ 22-ACULYN™ 28 and Acusol™ 801 S, Acusol™ 805 S, Acusol™820 and Acusol™823 trade names from Rohm and Haas and under the Rheovis® and Latekoll® trade names from BASF.

Preference is given to using Novethix™ L-10 Polymer from Lubrizol and Acusol™820 and Acusol™823 from Rohm and Haas and Rheovis® and Latekoll® from BASF as rheology modifiers, preferably in washing and cleaning compositions. Even more preferred are Novethix™ L-10 Polymer and Rheovis®, and Novethix™ L-10 Polymer is the most preferred. Novethix™ L-10 Polymer is an (INCI:) Acrylates/Beneth-25 Methacrylate Copolymer having a viscosity of 15 mPa·s (Brookfield RVT@20 rpm, 25° C. and a pH of 3.0 and a turbidity of <20 NTU (DRT-100B Turbidimeter (HF Scientific), 1 wt % TS Gel Properties at pH=7.5 (neutralized with NaOH))).

ii) Polymers of the ASE type are solubilized alkali-soluble polymers. They are preferably aqueous solutions of alkali-soluble emulsion polymers. This polymer type is analogous to the HASE polymer and can be represented, for example, by the following formula II:

Formula II

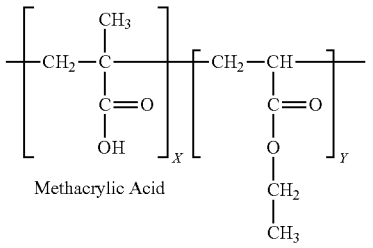

Methacrylic Acid

Ethyl Acrylate

The "methacrylic acid" group is the anionic monomer unit and the "ethyl acrylate" group the nonionic monomer unit. The methyl group and ethyl group in the "methacrylic acid" and "ethyl acrylate" groups from formula II are not restricted to methyl and ethyl for use according to the invention in the stabilization system. Formula II merely shows an illustrative formula for an ASE polymer and has no limiting effect on the ASE polymers used in the present application.

Thus, formula IIa shows a more general formula of an ASE polymer which can likewise be used as a rheology modifier in the present invention:

Formula IIa

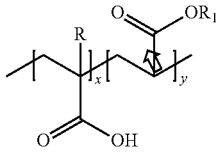

ASE polymers are preferably prepared by emulsion polymerization of acids and acrylate comonomers. The representation of the ASE polymer compositions is analogous to the HASE polymer compositions, and so the anionic and nonionic monomers used with preference which have been listed in the description under HASE likewise apply to the ASE polymers.

Suitable ASE polymer compositions which are used as rheology modifiers in the present invention are available under the Aculyn™38, Acusol™ 810 A, Acusol™ 830, Acusol™ 835, Acusol™ 842 trade names from Rohm and Haas and under the Polygel® trade name from Neochem (Polygel W400) and under the Viscalex®, Latecoll® and Collacral® trade names from BASF.

Preference is given to using Acusol™ 835, Acusol™ 842 from Rohm and Haas and Polygel® from Neochem (Polygel W400) and Viscalex®, Latecoll® and Collacral® from BASF, preferably in washing and cleaning compositions. Even more preferred are Polygel W400 and Latecoll®.

Suitable silicates are preferably sheet silicates which are a mixture of a plurality of components. Such a sheet silicate preferably contains the following composition: 40% to 60% SiO2, 20% to 30% MgO, 0.3% to 0.9% Li2O, 1.5% to 3% Na2O, and such a sheet silicate preferably has a BET of 345 $m^2/g$ to 390 $m^2/g$. Particular preference is given to sheet silicates having a composition composed of 50% to 60% SiO2, 25% to 28% MgO, 0.5% to 0.8% Li2O, 2.0% to 2.8% Na2O and preferably a BET of 355 $m^2/g$ to 380 $m^2/g$. Very particular preference is given to sheet silicates consisting of 59.5% SiO2, 27.5% MgO, 0.8% Li02 and 2.8% Na2O and having a BET of 370 $m^2/g$ and a pH of 9.8 (2% suspension).

Suitable sheet silicates which are used as rheology modifiers in the present invention are available under the Laponite® OG, Laponite®EP, Laponite® RD trade names from Rockwood.

In a preferred embodiment, the stabilization system according to the invention comprises, as rheology modifier, 2,3-bis(12-hydroxyoctadecanoloxy)propyl 12-hydroxyoctadecanoate or a mixture of sheet silicates with polyacrylates, especially HASE polymers or ASE polymers.

In a preferred embodiment, the stabilization system according to the invention comprises 2,3-bis(12-hydroxyoctadecanoloxy)propyl 12-hydroxyoctadecanoate as rheology modifier, preferably Thixcin®.

In a preferred embodiment, the stabilization system according to the invention comprises, as rheology modifier, a mixture of a sheet silicate with a polyacrylate, where the sheet silicate preferably has the following composition: about 40% to 60% by weight of $SiO_2$, about 20% to 30% by weight of MgO, about 0.3% to 0.9% by weight of $Li_2O$, about 1.5% to 3% by weight of $Na_2O$, such a sheet silicate preferably having a BET of about 345 to 390 $m^2/g$.

In a preferred embodiment, the stabilization system according to the invention comprises, as rheology modifier, an HASE polymer or an ASE polymer. Preferably, the polyacrylate is (INCI:) Acrylates/Beneth-25 Methacrylate Copolymer, preferably Novethix™L-10 Polymer.

In a preferred embodiment, the stabilization system according to the invention comprises, as rheology modifier, a polyacrylate which is a latex polyacrylate, especially an anionic polyacrylate emulsion, preferably Polygel W 301.

In a preferred embodiment, the stabilization system according to the invention comprises, as rheology modifier, a polyacrylate which is a polyacrylate emulsion comprising about 30% by weight of active material, preferably Polygel W400.

In a preferred embodiment, the stabilization system according to the invention comprises, as rheology modifier, a polyacrylate which is a crosslinked polyacrylate dispersion containing about 30% by weight of active material, preferably Carbopol® Aqua 30 Polymer.

In a preferred embodiment, the sheet silicate consists of 59.5% by weight of $SiO_2$, 27.5% by weight of MgO, 0.8% by weight of $Li_2O$ and 2.8% by weight of $Na_2O$, and has a BET of 370 $m^2/g$ and a pH of 9.8 (2% suspension). Preferably, the sheet silicate to be used is Laponite® OG.

In the case of use in washing and cleaning compositions, the amount of the sheet silicate in relation to the polyacrylate is preferably from 0.025:1 to 1:50, preferably from 0.05:1 to 1:20, most preferably 0.075:1-1:13.3.

In a preferred embodiment, the active ingredients and other ingredients in the capsules to be stabilized are preferably selected from the group consisting of fragrances, builders, bleach activators, enzymes, greying inhibitors, dyes, hydrotropes, active antimicrobial ingredients, germicides, fungicides, antioxidants. These active ingredients and other ingredients are more preferably fragrances, builders and enzymes. Most preferably, fragrances are present in the capsules.

The invention further relates to the use of the stabilization system according to the invention, comprising at least one rheology modifier, for production of washing and cleaning compositions. In this case, the ingredients of the capsules are preferably fragrances selected from the group of the aldehyde fragrances, ketone fragrances, prodrugs and mixtures thereof. Preferably, the fragrance capsules are stabilized in the washing and cleaning composition by the rheology modifier in such a way that the capsules do not sediment or rise upward, but are kept suspended.

The invention also relates to the use of at least one rheology modifier, namely 2,3-bis(12-hydroxyoctadecanoloxy)propyl 12-hydroxyoctadecanoate or a mixture of sheet silicates with polyacrylates, preferably HASE polymers or ASE polymers, for stabilization of fragrance capsules in washing and cleaning compositions.

In a preferred embodiment, the rheology modifier comprises 2,3-bis(12-hydroxyoctadecanoloxy)propyl 12-hydroxyoctadecanoate, preferably Thixcin®.

In a preferred embodiment, the rheology modifier comprises a mixture of a sheet silicate with a polyacrylate, the sheet silicate preferably having the following composition: about 40% to 60% by weight of $SiO_2$, about 20% to 30% by weight of MgO, about 0.3% to 0.9% by weight of $Li_2O$, about 1.5% to 3% by weight of $Na_2O$, such a sheet silicate preferably having a BET of about 345 to 390 $m^2/g$.

In a preferred embodiment, the polyacrylate is an HASE polymer or an ASE polymer. Preferably, the polyacrylate is (INCI:) Acrylates/Beneth-25 Methacrylate Copolymer, preferably Novethix™L-10 Polymer.

In a preferred embodiment, the polyacrylate is a latex polyacrylate, especially an anionic polyacrylate emulsion, preferably Polygel W 301.

In a preferred embodiment, the polyacrylate is a polyacrylate emulsion comprising about 30% by weight of active material, preferably Polygel W400.

In a preferred embodiment, the polyacrylate is a crosslinked polyacrylate dispersion comprising about 30% by weight of active material, preferably Carbopol® Aqua 30 Polymer.

In a preferred embodiment, the sheet silicate consists of 59.5% by weight of $SiO_2$, 27.5% by weight of MgO, 0.8% by weight of $Li_2O$ and 2.8% of $Na_2O$ and has a BET of about 370 $m^2/g$ and a pH of 9.8 (2% suspension). Preferably, the sheet silicate to be used is Laponite® OG.

The present invention likewise relates to washing and cleaning compositions comprising at least one rheology modifier for stabilization of capsules having an average particle size distribution from 0.1 nm to 1 mm. The rheology modifier is preferably selected from the group consisting of hydrogenated castor oils, hydrogenated castor waxes, sheet silicates, polyacrylates and mixtures thereof, the polyacrylates preferably being latex polyacrylates, polyacrylate emulsions, polyacrylate dispersions or polymers of the Hase or ASE type. Washing and cleaning compositions according to the invention are preferably in the form of liquid emulsions, suspensions or dispersions, and contain rheology modifiers in the range from 0.01% by weight to 40% by weight, preferably in the range from 0.1% by weight to 30% by weight, and most preferably in the range from 0.15% by weight to 25% by weight, based on the overall formulation.

Preferred liquid washing and cleaning compositions contain the polyacrylate in an amount of about 0.01% to 10% by weight and preferably about 0.15% to 5% by weight.

The ratio of sheet silicates to polyacrylate in the washing and cleaning compositions according to the invention is preferably from about 0.025:1 to 1:50, preferably from about 0.05:1 to 1:20, most preferably about 0.075:1-1:13.3.

In addition, washing and cleaning compositions according to the invention may contain a solvent component comprising dipropylene glycol. Especially preferably, the solvent component comprises dipropylene glycol and propane-1,2-diol. The ratio of dipropylene glycol to propane-1,2-diol is advantageously between 3:1 and 1:3 and is most preferably 1:1. The amount of the solvent component based on the total amount of the washing and cleaning composition is about 0.5% to 15% by weight and preferably about 2% to 9% by weight.

The washing and cleaning compositions are especially preferably aqueous, meaning that they have a water content of greater than 5% by weight, preferably greater than 15% by weight and especially preferably greater than 25% by weight.

The active ingredients and other ingredients present in the washing and cleaning compositions according to the invention are described in detail hereinafter. However, the lists of these active ingredients and other ingredients are non-limiting and may include further active ingredients and other ingredients that are not elucidated further below.

Fragrances

Fragrances or perfume oils which are used with preference and can be incorporated into the compositions are not subject to any restrictions at all. For instance, fragrances used may be individual odourant compounds, both synthetic or natural compounds of the ester, ether, aldehyde, ketone, alcohol, hydrocarbon, acid, carboxylic ester, aromatic hydrocarbon, aliphatic hydrocarbon, saturated and/or unsaturated hydrocarbon type, and mixtures thereof. Fragrance aldehydes or fragrance ketones used may be all the customary fragrance aldehydes and fragrance ketones which are typically used to bring about a pleasant fragrance sensation. Suitable fragrance aldehydes and fragrance ketones are common knowledge to those skilled in the art. Fragrance ketones may include all ketones which can impart a desirable fragrance or a sensation of freshness. It is also possible to use mixtures of different ketones. For example, the ketone may be selected from the group consisting of buccoxime, isojasmone, methyl beta-naphthyl ketone, musk indanone, Tonalid/musk plus, alpha-damascone, beta-damascone, delta-damascone, isodamascone, damascenone, damarose, methyl dihydrojasmonate, menthone, carvone, camphor, fenchone, alpha-ionone, beta-ionone, dihydro-beta-ionone, gamma-methylionone (so-called), fleuramone, dihydrojasmone, cisjasmone, Iso-E-Super, methyl cedrenyl ketone or methyl-cedrylone, acetophenone, methylacetophenone, para-methoxyacetophenone, methyl beta-naphthyl ketone, benzylacetone, benzophenone, para-hydroxyphenylbutanone, celery ketone or livescone, 6-isopropyldecahydro-2-naphthone, dimethyloctenone, Freskomenthe, 4-(1-ethoxyvinyl)-3,3,5,5-tetramethylcyclohexanone, methylheptenone, 2-(2-(4-methyl-3-cyclohexen-1-yl)propyl)cyclopentanone, 1-(p-menthen-6(2)-yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)-indanone, 4-damascol, dulcinyl or cassione, gelsone, hexalone, isocyclemone E, methyl-cyclocitrone, methylavender ketone, orivone, para-tert-butylcyclohexanone, verdone, delphone, muscone, neobutenone, plicatone, veloutone, 2,4,4,7-tetramethyloct-6-en-3-one, tetramerane, hedione and mixtures thereof. The ketones may preferably be selected from alpha-damascone, delta-damascone, isodamascone, carvone, gamma-methylionone, Iso-E-Super, 2,4,4,7-tetramethyloct-6-en-3-one, benzylacetone, beta-damascone, damascenone, methyl dihydrojasmonate, methylcedrylone, hedione and mixtures thereof.

Suitable fragrance aldehydes may be any desired aldehydes which, in the same way as for the fragrance ketones, impart a desired odour or a sensation of freshness. Again they may be individual aldehydes or aldehyde mixtures. Suitable aldehydes are, for example, melonal, triplal, ligustral, adoxal, anisaldehyde, cymal, ethylvanillin, florhydral, floralozone, helional, heliotropin, hydroxycitronellal, koavone, lauryl aldehyde, canthoxal, lyral, lilial, adoxal, anisaldehyde, cumal methylnonylacetaldehyde, citronellal, citronellyloxy-acetaldehyde, cyclamen aldehyde, bourgeonal, p,t-bucinal, phenylacetaldehyde, undecylenealdehyde, vanillin; 2,6,10-trimethyl-9-undecenal, 3-dodecen-1-al, alpha-n-amylcinnamaldehyde, 4-methoxybenzaldehyde, benzaldehyde, 3-(4-tert-butylphenyl)propanal, 2-methyl-3-(para-methoxyphenyl)propanal, 2-methyl-4-(2,6,6-trimethyl-2(1)-cyclohexen-1-yl)butanal, 3-phenyl-2-propenal, cis/trans-3,7-dimethyl-2,6-octadien-1-al, 3,7-dimethyl-6-octen-1-al, [(3,7-dimethyl-6-octenyl)oxy]acetaldehyde, 4-isopropylbenzyl aldehyde, 1,2,3,4,5,6,7,8-octahydro-8,8-dimethyl-2-naphthaldehyde, 2,4-dimethyl-3-cyclohexene-1-carboxyaldehyde, 2-methyl-3-(isopropylphenyl)propanal, decyl aldehyde, 2,6-dimethyl-5-heptenal; 4-(tricyclo[5.2.1.0$^{(2,6)}$]decylidene-8)-butanal; octahydro-4,7-methano-1H-indenecarboxaldehyde; 3-ethoxy-4-hydroxybenzaldehyde, para-ethyl-alpha,alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexenecarboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctan-1-al, 2-methylundecanal, 2-methyldecanal, 1-nonanal, 1-octanal, 2,6,10-trimethyl-5,9-undecadienal, 2-methyl-3-(4-tert-butyl)propanal, 3-(4-ethylphenyl)-2,2-dimethylpropanal, 3-(4-methoxyphenyl)-2-methylpropanal, methylnonylacetaldehyde, 2-phenylpropan-1-al, 3-phenylprop-2-en-1-al, 3-phenyl-2-pentylprop-2-en-1-al, 3-phenyl-2-hexylprop-2-enal, 3-(4-isopropylphenyl)-2-methylpropan-1-al, 3-(4-ethylphenyl)-2,2-dimethylpropan-1-al, 3-(4-tert-butylphenyl)-2-methylpropanal, 3-(3,4-methylenedioxyphenyl)-2-methylpropan-1-al, 3-(4-ethylphenyl)-2,2-dimethylpropanal, 3-(3-isopropylphenyl)butan-1-al, 2,6-dimethylhept-5-en-1-al, dihydrocinnamaldehyde, 1-methyl-4-(4-methyl-3-pentenyl)-3-cyclohexene-1-carboxaldehyde, 5- or 6-methoxyhexahydro-4,7-methanoindane-1- or -2-carboxyaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxyaldehyde, 7-hydroxy-3,7-dimethyloctanal; trans-4-decenal, 2,6-nonadienal, para-tolylacetaldehyde; 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexenecarboxaldehyde, 3,7-dimethyl-2-methylene-6-octenal, phenoxyacetaldehyde; 5,9-dimethyl-4,8-decadienal, peony aldehyde (6,10-dimethyl-3-oxa-5,9-undecadien-1-al), hexahydro-4,7-methanoindane-1-carboxaldehyde, octanal, 2-methyloctanal, alpha-methyl-4-(1-methylethyl)benzeneacetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propylbicyclo[2.2.1]hept-5-ene-2-carbaldehyde, 9-decenal, 3-methyl-5-phenyl-1-pentanal, methylnonylacetaldehyde, 1-p-menthene-q-carboxaldehyde, citral or mixtures thereof, lilial citral, 1-decanal, n-undecanal, n-dodecanal, florhydral, 2,4-dimethyl-3-cyclohexene-1-carboxaldehyde, 4-methoxybenzaldehyde, 3-methoxy-4-hydroxybenzaldehyde, 3-ethoxy-4-hydroxybenzaldehyde, 3,4-methylenedioxybenzaldehyde and 3,4-dimethoxybenzaldehyde and mixtures thereof. As observed by way of example above, the fragrance aldehydes and fragrance ketones may have an aliphatic, cycloaliphatic, aromatic, ethylenically unsaturated structure or a combination of these structures. There may also be further heteroatoms or polycyclic structures present. The structures may have suitable substituents such as hydroxyl groups or amino groups. For further suitable fragrances, selected from aldehydes and ketones, reference is made to Steffen Arctander, published 1960 and 1969 respectively, reprinted 2000 ISBN: Aroma Chemicals Vol. 1: 0-931710-37-5, Aroma Chemicals Vol. 2: 0-931710-38-3.

Suitable odourant compounds of the ester type are, for example, benzyl acetate, phenoxyethyl isobutyrate, p-tert-butylcyclohexyl acetate, linalyl acetate, dimethylbenzyl carbinyl acetate (DMBCA), phenylethyl acetate, benzyl acetate, ethyl methyl phenylglycinate, allyl cyclohexylpropionate, styrallyl propionate, benzyl salicylate, cyclohexyl salicylate, floramate, melusate and jasmacyclate. Odourant compounds of the hydrocarbon type are, for example, terpenes such as limonene and pinene. Suitable fragrances of the ether type are, for example, benzyl ethyl ether and ambroxane. Suitable fragrance alcohols are, for example, 10-undecen-1-ol, 2,6-dimethylheptan-2-ol, 2-methylbutanol, 2-methylpentanol, 2-phenoxyethanol, 2-phenylpropanol, 2-tert-butylcyclohexanol, 3,5,5-trimethylcyclohexanol, 3-hexanol, 3-methyl-5-phenylpentanol, 3-octanol, 1-octen-3-ol, 3-phenylpropanol, 4-heptenol, 4-isopropylcyclohexanol, 4-tert-butylcyclohexanol, 6,8-dimethyl-2-nonanol, 6-nonen-1-ol, 9-decen-1-ol, alpha-methylbenzyl alcohol, alpha-terpineol, amyl salicylate, benzyl alcohol, benzyl salicylate, beta-terpineol, butyl salicylate, citronellol, cyclohexyl salicylate, decanol, dihydromyrcenol, dimethylbenzyl carbinol, dimethylheptanol, dimethyloctanol, ethyl salicylate, ethylvanillin, anethol, eugenol, geraniol, heptanol, hexyl salicylate, isoborneol, isoeugenol, isopulegol, linalool, menthol, myrtenol, n-hexanol, nerol, nonanol, octanol, para-menthan-7-ol, phenylethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, and cinnamyl alcohol; if two or more fragrance alcohols are present, they may be selected independently of one another.

Fragrances and perfume oils may also be natural odourant mixtures, such as those obtainable from plant sources, examples being pine, citrus, jasmine, patchouli, rose or ylang-ylang oil. Likewise suitable are clary sage oil, camomile oil, clove oil, balm oil, mint oil, cinnamon leaf oil, lime blossom oil, juniper berry oil, vetiver oil, olibanum oil, galbanum oil and labdanum oil, and also orange blossom oil, neroli oil, orange peel oil and sandalwood oil. Essential oils such as angelica root oil, aniseed oil, arnica blossom oil, basil oil, bay oil, champaca flower oil, silver fir oil, silver fir cone oil, elemi oil, eucalyptus oil, fennel oil, pine needle oil, galbanum oil, geranium oil, gingergrass oil, guaiac wood oil, gurjan balsam oil, helichrysum oil, ho oil, ginger oil, iris oil, cajeput oil, sweet flag oil, camomile oil, camphor oil, cananga oil, cardamom oil, cassia oil, pine needle oil, copaiba balsam oil, coriander oil, spearmint oil, caraway oil, cumin oil, lavender oil, lemongrass oil, lime oil, mandarin oil, melissa oil, amber seed oil, myrrh oil, clove oil, neroli oil, niaouli oil, olibanum oil, oregano oil, palmarosa oil, patchouli oil, peru balsam oil, petitgrain oil, pepper oil, peppermint oil, pimento oil, pine oil, rose oil, rosemary oil, sandalwood oil, celery oil, spike oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, citrus oil and cypress oil.

Likewise suitable as fragrance are what are called fragrance precursors (pro-drugs). This class of compounds comprises compounds which release a desired odour molecule and/or fragrance molecule through the breaking of a chemical bond, by hydrolysis, for example. To form a fragrance precursor, typically, a desired fragrance raw material is joined chemically to a carrier, preferably a carrier of low or moderate volatility. The combination results in a less volatile and more strongly hydrophobic fragrance precursor, with better attachment to materials. The fragrance is released subsequently by breaking of the bond between the fragrance raw material and the carrier, as a result of a change in pH, for example (through perspiration during wear, for example), atmospheric humidity, heat and/or sunlight during storage or during drying on a washing line.

The fragrance raw material for use in fragrance precursors typically comprises saturated or unsaturated volatile compounds containing an alcohol, an aldehyde and/or a ketone group. The fragrance raw materials that are useful herein include any pleasingly odourous substances or mixtures of substances which have already been described above.

Particularly advantageous fragrance precursors which can be used conform to the formula (III)

$$R—C(OR^1)(OR^2)—OR^3 \quad \text{(III)}$$

in which R is hydrogen, linear $C_1$-$C_8$ alkyl, branched $C_3$-$C_{20}$ alkyl, cyclic $C_3$-$C_{20}$ alkyl, branched cyclic $C_6$-$C_{20}$ alkyl, linear $C_6$-$C_{20}$ alkenyl, branched $C_6$-$C_{20}$ alkenyl, cyclic $C_6$-$C_{20}$ alkenyl, branched cyclic $C_6$-$C_{20}$ alkenyl, substituted or unsubstituted $C_6$-$C_{20}$ aryl and mixtures thereof; $R^1$, $R^2$ and $R^3$ independently are linear, branched or substituted $C_1$-$C_{20}$ alkyl; linear, branched or substituted $C_2$-$C_{20}$ alkenyl;

substituted or unsubstituted, cyclic $C_3$-$C_{20}$ alkyl; substituted or unsubstituted $C_6$-$C_{20}$ aryl, substituted or unsubstituted $C_2$-$C_{40}$ alkyleneoxy; substituted or unsubstituted $C_3$-$C_{40}$ alkyleneoxyalkyl; substituted or unsubstituted $C_6$-$C_{40}$ alkylenearyl; substituted or unsubstituted $C_6$-$C_{32}$ aryloxy; substituted or unsubstituted $C_6$-$C_{40}$ alkyleneoxyaryl; $C_6$-$C_{40}$ oxyalkylenearyl and mixtures thereof. The use of such substances, especially in (preferably water-insoluble) microcapsules, corresponds to one preferred embodiment of the invention.

Further particularly advantageous fragrance precursors which can be used are acetals or ketals, preferably conforming to the formula (IV)

$$R—C(R^1)(OR^3)—OR^2 \quad (IV)$$

in which R is linear $C_1$-$C_{20}$ alkyl, branched $C_3$-$C_{20}$ alkyl, cyclic $C_6$-$C_{20}$ alkyl, branched cyclic $C_6$-$C_{20}$ alkyl, linear $C_2$-$C_{20}$ alkenyl, branched $C_3$-$C_{20}$ alkenyl, cyclic $C_6$-$C_{20}$ alkenyl, branched cyclic $C_6$-$C_{20}$ alkenyl, substituted or unsubstituted $C_6$-$C_{20}$ aryl and mixtures thereof; $R^1$ is hydrogen or R; $R^2$ and $R^3$ are each independently selected from the group consisting of linear $C_1$-$C_{20}$ alkyl, branched $C_3$-$C_{20}$ alkyl, cyclic $C_3$-$C_{20}$ alkyl, branched cyclic $C_6$-$C_{20}$ alkyl, linear $C_6$-$C_{20}$ alkenyl, branched $C_6$-$C_{20}$ alkenyl, cyclic $C_6$-$C_{20}$ alkenyl, branched cyclic $C_6$-$C_{20}$ alkenyl, $C_6$-$C_{20}$ aryl, substituted $C_7$-$C_{20}$ aryl and mixtures thereof. The use of such substances, especially in (preferably water-insoluble) microcapsules, corresponds to one preferred embodiment of the invention.

Further particularly advantageous fragrance precursors which can be used conform to the formula (V)

$$R^4O—C(OR^1)(OR^3)—OR^2 \quad (V)$$

in which $R^1$, $R^2$, $R^3$ and $R^4$ are each independently linear, branched or substituted $C_1$-$C_{20}$ alkyl; linear, branched or substituted $C_2$-$C_{20}$ alkenyl; substituted or unsubstituted, cyclic $C_5$-$C_{20}$ alkyl; substituted or unsubstituted $C_6$-$C_{20}$ aryl, substituted or unsubstituted $C_2$-$C_{40}$ alkyleneoxy; substituted or unsubstituted $C_3$-$C_{40}$ alkyleneoxyalkyl; substituted or unsubstituted $C_6$-$C_{40}$ alkylenearyl; substituted or unsubstituted $C_6$-$C_{32}$ aryloxy; substituted or unsubstituted $C_6$-$C_{40}$ alkyleneoxyaryl; $C_6$-$C_{40}$ oxyalkylenearyl; and mixtures thereof. The use of such substances, especially in (preferably water-insoluble) microcapsules, corresponds to one preferred embodiment of the invention.

It is particularly preferable for the odourants used to comprise silicic ester mixtures. Silicic esters are described for example by the formula (VI)

$$R—(—O—Si(OR)_2—)_n—OR \quad (VI)$$

where each R is independently selected from the group containing H, the straight-chain or branched, saturated or unsaturated, substituted or unsubstituted $C_1$-$C_6$ hydrocarbon radicals and the fragrance alcohol radicals and/or biocide alcohol radicals, and m adopts values from the range from 1 to 20 and n adopts values from the range from 2 to 100. The silicic esters of the formula (VI) preferably comprise at least one fragrance alcohol radical and/or biocide alcohol radical.

The silicic ester mixtures may be used in encapsulated form, but also in unencapsulated form. The effect of the presence of silicic ester mixtures is often that the fragrance impression achievable, both with regard to pleasance and intensity, can be improved still further. The fragrance impression is not just qualitatively better, i.e. with regard to pleasance, but also lasts longer.

The silicic ester mixtures may also be present in the microcapsules. If the silicic ester mixtures in the microcapsules make up preferably at least 2% by weight of the total amount of encapsulated odourant, this is a preferred embodiment of the invention, which brings about a further improvement in the desired pleasing odour effect after drying.

Particularly suitable fragrance precursors are reaction products of compounds comprising at least one primary and/or secondary amine group, for example an amino-functional polymer, especially an amino-functional silicone, and a fragrance constituent selected from ketone, aldehyde and mixtures thereof. The use of such substances, especially in (preferably water-insoluble) microcapsules, corresponds to a preferred embodiment of the invention.

The total amount of fragrances in the washing and cleaning composition according to the invention is preferably between 0.01% and 5% by weight, more preferably between 0.1% and 3% by weight and most preferably between 0.5% and 2% by weight, based on the total amount of the composition.

Preference is given to using mixtures of different fragrances (from the different fragrance classes mentioned above) which together produce a pleasing fragrance note. In this case, the total amount of the at least one fragrance is the amount of all the fragrances in the mixture together, based on the total amount of the composition.

These fragrances and perfume oils are preferably in encapsulated form, and so the stabilization system according to the invention for capsules is employed here.

Liquid Washing Compositions

The liquid washing compositions may comprise further constituents customary in the art, for example surfactants, builders, bleaches, bleach activators, thickeners, enzymes, electrolytes, pH modifiers, dyes and fragrances, foam inhibitors, antiredeposition agents, optical brighteners, greying inhibitors, anti-crease agents, active antimicrobial ingredients, preservatives, antioxidants, antistats, UV absorbers, heavy metal complexing agents and the like. These auxiliaries are described in detail hereinafter:

A. Surfactants

Surfactants used for production of the washing or cleaning compositions may, as well as the nonionic surfactants, also be anionic, cationic, amphoteric and/or nonionic surfactants and branched alkyl sulphates.

Nonionic surfactants used are preferably alkoxylated, advantageously ethoxylated, especially primary alcohols having preferably 8 to 18 carbon atoms and an average of 1 to 12 mol of ethylene oxide (EO) per mole of alcohol, in which the alcohol radical may be linear or preferably 2-methyl-branched, and/or may contain linear and methyl-branched radicals in a mixture, as typically present in oxo process alcohol radicals. In particular, however, preference is given to alcohol ethoxylates having linear radicals from alcohols of native origin having 12 to 18 carbon atoms, for example from coconut alcohol, palm alcohol, tallow fat alcohol or oleyl alcohol, and an average of 2 to 8 EO per mole of alcohol. The preferred ethoxylated alcohols include, for example, C12-14 alcohols with 3 EO, 4 EO or 7 EO, C9-11 alcohol with 7 EO, C13-15 alcohols with 3 EO, 5 EO, 7 EO or 8 EO, C12-18 alcohols with 3 EO, 5 EO or 7 EO and mixtures of these, such as mixtures of C12-14 alcohol with 3 EO and C12-18 alcohol with 7 EO. The stated degrees of ethoxylation are statistical average values which may be an integer or a fraction for a specific product. Preferred alcohol ethoxylates have a narrowed homologue distribution (narrow range ethoxylates, NRE). In addition to these nonionic surfactants, it is also possible to use fatty alcohols with more than 12 EO. Examples thereof are tallow fat alcohol with 14 EO, 25 EO, 30 EO or 40 EO. Nonionic surfactants which contain EO and PO groups together in the molecule can also be used in accordance with the invention. In this case, it is possible to use block copolymers with EO-PO block units or PO-EO block units, but also EO-PO-EO copolymers and PO-EO-PO copolymers. It is of course also possible to use nonionic surfactants having mixed alkoxylation, in which EO and PO units are not in block distribution, but in random distribution. Such products are obtainable as a result of the simultaneous action of ethylene oxide and propylene oxide on fatty alcohols.

A further class of nonionic surfactants which can be used advantageously for production of washing or cleaning compositions is that of the alkyl polyglycosides (APG). Usable alkyl polyglycosides satisfy the general formula RO(G)Z in which R is a linear or branched, especially 2-methyl-branched, saturated or unsaturated, aliphatic radical having 8 to 22, preferably 12 to 18, carbon atoms, and G is the symbol which represents a glycose unit having 5 or 6 carbon atoms, preferably glucose. The glucosidation level z here is between 1.0 and 4.0, preferably between 1.0 and 2.0 and especially between 1.1 and 1.4.

Nonionic surfactants of the amine oxide type, for example N-cocoalkyl-N,N-dimethylamine oxide and N-tallowalkyl-N,N-dihydroxyethylamine oxide, and the fatty acid alkanolamides may also be suitable for producing the washing or cleaning compositions. The amount of these nonionic surfactants is preferably not more than that of the ethoxylated fatty alcohols, especially not more than half thereof.

Further suitable surfactants are polyhydroxy fatty acid amides of the formula

R—CO—N(R1)-[Z] in which RCO is an aliphatic acyl radical having 6 to 22 carbon atoms, R1 is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which can typically be obtained by reductive amination of a reducing sugar with ammonia, an alkylamine or an alkanolamine and subsequent acylation with a fatty acid, a fatty acid alkyl ester or a fatty acid chloride. The group of polyhydroxy fatty acid amides also includes compounds of the formula R—CO—N(R1-O—R2)-[Z] in which R is a linear or branched alkyl or alkenyl radical having 7 to 12 carbon atoms, R1 is a linear, branched or cyclic alkyl radical or an aryl radical having 2 to 8 carbon atoms, and R2 is a linear, branched or cyclic alkyl radical or an aryl radical or an oxyalkyl radical having 1 to 8 carbon atoms, preference being given to C1-4 alkyl or phenyl radicals, and [Z] is a linear polyhydroxyalkyl radical wherein the alkyl chain is substituted by at least two hydroxyl groups, or alkoxylated, preferably ethoxylated or propoxylated derivatives of this radical. [Z] is preferably obtained by reductive amination of a sugar, for example glucose, fructose, maltose, lactose, galactose, mannose or xylose. The N-alkoxy- or N-aryloxy-substituted compounds can then be converted to the desired polyhydroxy fatty acid amides by reaction with fatty acid methyl esters in the presence of an alkoxide as catalyst.

The content of nonionic surfactants in the liquid washing and cleaning compositions is preferably 5% to 30% by weight, preferably 7% to 20% by weight and especially 9% to 15% by weight, based in each case on the overall composition.

Anionic surfactants used are, for example, those of the sulphonate and sulphate types. Useful surfactants of the sulphonate type are preferably C9-13 alkylbenzenesulphonates, olefinsulphonates, i.e. mixtures of alkene- and hydroxyalkanesulphonates, and also disulphonates, as obtained for example from C12-18 monoolefins having a terminal or internal double bond by sulphonation with gaseous sulphur trioxide and subsequent alkaline or acidic hydrolysis of the sulphonation products. Also suitable are alkanesulphonates which are obtained from C12-18 alkanes, for example by sulphochlorination or sulphoxidation with subsequent hydrolysis or neutralization. Equally suitable are also the esters of alpha-sulpho fatty acids (ester sulphonates), for example the alpha-sulphonated methyl esters of hydrogenated coconut, palm kernel or tallow fatty acids.

Also suitable are sulphonation products of unsaturated fatty acids, for example oleic acid, in small amounts, preferably in amounts not exceeding about 2% to 3% by weight. In particular, preference is given to alpha-sulpho fatty acid alkyl esters having an alkyl chain having not more than 4 carbon atoms in the ester group, for example methyl esters, ethyl esters, propyl esters and butyl esters. It is particularly advantageous to use the methyl esters of the alpha-sulpho fatty acids (MES), but also the hydrolysed disalts thereof.

Further useful anionic surfactants include fatty acid derivatives of amino acids, for example of N-methyltaurine (taurides) and/or of N-methylglycine (sarcosides). Especially preferred here are the sarcosides and/or the sarcosinates, and here especially sarcosinates of higher and optionally mono- or polyunsaturated fatty acids such as oleyl sarcosinate.

Further suitable anionic surfactants are sulphated fatty acid glycerol esters. Fatty acid glycerol esters should be understood to mean the mono-, di- and triesters, and also mixtures thereof, as obtained in the preparation by esterification of a monoglycerol with 1 to 3 mol of fatty acid or in the transesterification of triglycerides with 0.3 to 2 mol of glycerol. Preferred sulphated fatty acid glycerol esters here are the sulphation products of saturated fatty acids having 6 to 22 carbon atoms, for example of caproic acid, caprylic acid, capric acid, myristic acid, lauric acid, palmitic acid, stearic acid or behenic acid.

Preferred alk(en)yl sulphates are the alkali metal and especially the sodium salts of the sulphuric monoesters of C12-C18 fatty alcohols, for example of coconut fat alcohol, tallow fat alcohol, lauryl, myristyl, cetyl or stearyl alcohol, or of the C10-C20-oxo alcohols and those monoesters of secondary alcohols of these chain lengths. Preference is further given to alk(en)yl sulphates of the stated chain length which contain a synthetic, petrochemical-based straight-chain alkyl radical and which have analogous degradation behaviour to the equivalent compounds based on oleochemical raw materials. For washing purposes, preference is given to the C12-C16 alkyl sulphates and C12-C15 alkyl sulphates, and also C14-C15 alkyl sulphates. 2,3-Alkyl sulphates, which can be obtained for example as commercial products from the Shell Oil Company under the DAN® name, are also suitable anionic surfactants.

Also suitable are the sulphuric monoesters of the straight-chain or branched C7-21 alcohols ethoxylated with 1 to 6 mol of ethylene oxide, such as 2-methyl-branched C9-11 alcohols with an average of 3.5 mol of ethylene oxide (EO) or C12-18 fatty alcohols with 1 to 4 EO. Because of their high propensity to foam, they are used in cleaning compositions only in relatively small amounts, for example in amounts of 1% to 5% by weight.

Further suitable anionic surfactants are also the salts of alkylsulphosuccinic acid, which are also referred to as sulphosuccinates or as sulphosuccinic acid esters and are the monoesters and/or diesters of sulphosuccinic acid with alcohols, preferably fatty alcohols and especially ethoxylated fatty alcohols. Preferred sulphosuccinates contain C8-18 fatty alcohol radicals or mixtures of these. Especially preferred sulphosuccinates contain a fatty alcohol radical derived from ethoxylated fatty alcohols which in themselves are nonionic surfactants (for description see below). Particular preference is in turn given to sulphosuccinates wherein the fatty alcohol radicals are derived from ethoxylated fatty alcohols having a narrowed homologue distribution. It is likewise also possible to use alk(en)ylsuccinic acid having preferably 8 to 18 carbon atoms in the alk(en)yl chain or salts thereof.

Especially preferred anionic surfactants are soaps. Suitable soaps are saturated and unsaturated fatty acid soaps, such as the salts of lauric acid, myristic acid, palmitic acid, stearic acid, (hydrogenated) erucic acid and behenic acid, and also especially soap mixtures derived from natural fatty acids, for example coconut, palm kernel, olive oil or tallow fatty acids.

The anionic surfactants including the soaps may be in the form of their sodium, potassium or ammonium salts, and also in the form of soluble salts of organic bases, such as mono-, di- or triethanolamine. Preferably, the anionic surfactants are in the form of their sodium or potassium salts, especially in the form of the sodium salts.

The content of anionic surfactants in preferred liquid washing and cleaning compositions is 1% to 30% by weight, preferably 4% to 25% by weight and especially 5% to 22% by weight, based in each case on the overall composition. It is particularly preferable for the amount of fatty acid soap to be at least 2% by weight and more preferably at least 3% by weight and especially preferably at least 4% by weight.

Useful further surfactants for production of the washing or cleaning compositions according to the invention are what are called gemini surfactants. These are generally understood to mean those compounds which have two hydrophilic groups and two hydrophobic groups per molecule. These groups are generally separated from one another by what is called a "spacer". This spacer is generally a carbon chain which should be long enough for the hydrophilic groups to be sufficiently separated that they can act independently of one another. Surfactants of this type are characterized in general by an unusually low critical micelle concentration and the ability to greatly reduce the surface tension of the water. In exceptional cases, however, the expression "gemini surfactants" is understood to mean not only dimeric but also trimeric surfactants.

Gemini surfactants for production of washing or cleaning compositions are, for example, sulphated hydroxy mixed ethers according to German patent application DE-A-43 21 022 or dimer alcohol bissulphates and trimer alcohol trissulphates and ether sulphates according to German patent application DE-A-195 03 061. End group-capped dimeric and trimeric mixed ethers according to German patent application DE-A-195 13 391 are especially notable for their bi- and multifunctionality. For instance, these end group-capped surfactants have good wetting properties and at the same time are low-foaming, meaning that they are especially suitable for use in machine washing or cleaning processes.

From an application point of view, preference is given to mixtures of anionic and nonionic surfactants. The total surfactant content of the liquid washing and cleaning composition is preferably below 40% by weight and more preferably below 35% by weight, based on the total liquid washing and cleaning composition.

B. Builders

Builders which may be present in the liquid washing and cleaning compositions are especially silicates, aluminium silicates (especially zeolites), carbonates, organic cobuilders, phosphates, salts of organic di- and polycarboxylic acids, and mixtures of these substances.

Suitable crystalline layered sodium silicates have the general formula $NaMSi_xO_{2x+1}*H_2O$ where M is sodium or hydrogen, x is a number from 1.9 to 4 and y is a number from 0 to 20, and preferred values of x are 2, 3 or 4. Preferred crystalline sheet silicates of the formula specified are those in which M is sodium and x assumes the values of 2 or 3. In particular, preference is given both to beta- and delta-sodium disilicates $Na_2Si_2O_5*yH_2O$.

It is also possible to use amorphous sodium silicates having an $Na_2O:SiO_2$ modulus of 1:2 to 1:3.3, preferably from 1:2 to 1:2.8 and especially from 1:2 to 1:2.6, which have delayed dissolution and secondary detergency properties. The dissolution delay compared with conventional amorphous sodium silicates may have been brought about here in various ways, for example as result of surface treatment, compounding, compaction/compression or as a result of overdrying. In the context of this invention, the term "amorphous" is also understood to mean "X-ray-amorphous". This means that, in X-ray diffraction experiments, the silicates do not give any sharp X-ray reflections, as are typical for crystalline substances, but at most give one or more maxima in the scattered X-ray radiation, which have a width of several degree units of the diffraction angle. It can, however, quite possibly even lead to particularly good builder properties if the silicate particles in electron diffraction experiments give indistinct or even sharp diffraction maxima. This should be interpreted in such a way that the products have microcrystalline regions of tens to a few hundreds of nm in size, preference being given to values of up to a maximum of 50 nm and especially up to a maximum of 20 nm. These are called X-ray amorphous silicates and likewise have a dissolution delay compared with conventional waterglasses. Particular preference is given to compressed/compacted amorphous silicates, compounded amorphous silicates and overdried X-ray-amorphous silicates.

A usable finely crystalline, synthetic zeolite containing bound water is preferably zeolite A and/or P. As zeolite P, particular preference is given to zeolite MAP™ (commercial product of Crosfield). Also suitable, however, are zeolite X and mixtures of A, X and/or P. Also commercially available and usable with preference in the context of the present invention is for example a cocrystallizate of zeolite X and zeolite A (about 80% by weight of zeolite X), which is sold by SASOL under the trade name VEGOBOND AX® and can be described by the formula $$n Na_2O*(1-n)K_2O*Al_2O_3.(2-2.5)*SiO_2.(3.5-5.5)*H_2O.$$

The zeolite can be used in the form of a spray-dried powder or else of an undried, stabilized suspension that is still wet from its preparation. If the zeolite is used in the form of a suspension, this may comprise small additives of nonionic surfactants as stabilizers, for example 1% to 3% by weight, based on zeolite, of ethoxylated $C_{12}$-$C_{18}$ fatty alcohols having 2 to 5 ethylene oxide groups, $C_{12}$-$C_{14}$ fatty alcohols having 4 to 5 ethylene oxide groups or ethoxylated isotridecanols. Suitable zeolites have a mean particle size of less than 10 μm (volume distribution; measurement method: Coulter counter) and contain preferably 18% to 22% by weight, especially 20% to 22% by weight, of bound water.

It is of course also possible to use the commonly known phosphates as builder substances, unless such a use should be avoided for environmental reasons. Of particular suitability are the sodium salts of the orthophosphates, the pyrophosphates and especially the tripolyphosphates.

Suitable builders are organic cobuilders, especially polycarboxylates/polycarboxylic acids, polymeric polycarboxylates, aspartic acid, polyacetals, dextrins, and phosphonates.

Polymeric polycarboxylates are for example the alkali metal salts of polyacrylic acid or of polymethacrylic acid, for example those having a relative molecular mass of 500 to 70 000 g/mol. The molar masses stated for polymeric polycarboxylates in the context of this specification are weight-average molar masses Mw of the particular acid form, which have been determined in principle by means of gel permeation chromatography (GPC), using a UV detector. The measurement was effected here against an external polyacrylic acid standard, which gives realistic molar mass values because of its structural similarity with the polymers examined. These data are distinctly different from the molar mass data where polystyrenesulphonic acids are used as the standard. The molar masses measured against polystyrenesulphonic acids are generally distinctly higher than the molar masses stated in this specification.

Suitable polymers are especially polyacrylates, which preferably have a molecular mass of 2000 to 20 000 g/mol. Because of their superior solubility, preference may be given in turn to the short-chain polyacrylates having molar masses of 2000 to 10 000 g/mol, and more preferably of 3000 to 5000 g/mol, from this group.

Also suitable are copolymeric polycarboxylates, especially those of acrylic acid with methacrylic acid and of acrylic acid or methacrylic acid with maleic acid. Particularly suitable copolymers have been found to be those of acrylic acid with maleic acid which contain 50% to 90% by weight of acrylic acid and 50% to 10% by weight of maleic acid. The relative molecular mass thereof, based on free acids, is generally 2000 to 70 000 g/mol, preferably 20 000 to 50 000 g/mol and especially 30 000 to 40 000 g/mol.

Also especially preferred are biodegradable polymers of more than two different monomer units, for example those which contain, as monomers, salts of acrylic acid and of maleic acid, and also vinyl alcohol or vinyl alcohol derivatives, or those which contain, as monomers, salts of acrylic acid and of 2-alkylallylsulphonic acid, and sugar derivatives.

Further preferred copolymers are those which include, as monomers, preferably acrolein and acrylic acid/acrylic acid salts or acrolein and vinyl acetate.

Further preferred builder substances likewise include polymeric aminodicarboxylic acids, salts thereof or precursor substances thereof. Particular preference is given to polyaspartic acids and salts and derivatives thereof which, as well as cobuilder properties, also have a bleach-stabilizing effect.

Further suitable builder substances are polyacetals which can be obtained by reacting dialdehydes with polyolcarboxylic acids having 5 to 7 carbon atoms and at least 3 hydroxyl groups. Preferred polyacetals are obtained from dialdehydes such as glyoxal, glutaraldehyde, terephthalaldehyde, and mixtures thereof and from polyolcarboxylic acids such as gluconic acid and/or glucoheptonic acid.

Further suitable organic builder substances are dextrins, for example oligomers and polymers of carbohydrates which can be obtained by partial hydrolysis of starches. The hydrolysis can be conducted by customary processes, for example acid- or enzyme-catalysed processes. The hydrolysis products are preferably those having average molar masses in the range from 400 to 500 000 g/mol. Preference is given to a polysaccharide having a dextrose equivalent (DE) in the range from 0.5 to 40, especially from 2 to 30, DE being a customary measure for the reducing action of a polysaccharide compared to dextrose, which has a DE of 100. It is possible to use either maltodextrins with a DE between 3 and 20 and dry glucose syrups having a DE between 20 and 37 or what are called yellow dextrins and white dextrins having higher molar masses in the range from 2000 to 30 000 g/mol.

The oxidized derivatives of such dextrins are the reaction products thereof with oxidizing agents, which are able to oxidize at least one alcohol function of the saccharide ring to the carboxylic acid function. A product oxidized at C6 of the saccharide ring may be particularly advantageous.

A preferred dextrin is described in British patent application GB 9,419,091 B1. The oxidized derivatives of such dextrins are their reaction products with oxidizing agents which are able to oxidize at least one alcohol function of the saccharide ring to the carboxylic acid function. Oxidized dextrins of this type and processes for preparation thereof are known for example from European patent applications EP 032202 A, EP 0427349 A, EP 0472042 A and EP 0542496 A, and international patent applications WO 1992/018542 A, WO 1993/008251 A, WO 1994/028030 A, WO 1995/007303 A, WO 1995/012619 A and WO 1995/020608 A. A product oxidized at $C_6$ of the saccharide ring may be particularly advantageous.

Further suitable cobuilders are also oxydisuccinates and other derivatives of disuccinates, preferably ethylenediamine disuccinate. Ethylenediamine N,N'-disuccinate (EDDS) is preferably used in the form of its sodium or magnesium salts. Preference is further given in this connection also to glycerol disuccinates and glycerol trisuccinates, as described for example in US patent specifications U.S. Pat. Nos. 4,524,009, and 4,639,325, in European patent application EP 0150930 A and Japanese patent application JP 1993/339896 A.

Further usable organic cobuilders are, for example, acetylated hydroxycarboxylic acids and salts thereof, which may optionally also be in lactone form and which contain at least 4 carbon atoms and at least one hydroxyl group, and not more than two acid groups. Cobuilders of this kind are described for example in international patent application WO 1995/020029 A.

A further substance class having cobuilder properties is that of the phosphonates. These are especially hydroxyalkane- and aminoalkanephosphonates. Among the hydroxyalkanephosphonates, 1-hydroxyethane-1,1-diphosphonate (HEDP) is of particular significance as cobuilder. It is preferably used as the sodium salt, with the disodium salt giving a neutral reaction and the tetrasodium salt giving an alkaline (pH 9) reaction. Useful aminoalkanephosphonates are preferably ethylenediaminetetramethylenephosphonate (EDTMP), diethylenetriaminepentamethylenephosphonate (DTPMP), and higher homologues thereof. They are preferably used in the form of the neutral-reacting sodium salts, e.g. as the hexasodium salt of EDTMP or as the hepta- and octasodium salt of DTPMP. The builder used here from the class of phosphonates is preferably HEDP. The aminoalkanephosphonates, moreover, have a marked heavy metal binding capacity. Accordingly, it may be preferable, especially if the washing and cleaning compositions also comprise bleach, to use aminoalkanephosphonates, especially DTPMP, or to use mixtures of the stated phosphonates for production of the compositions.

In addition, it is possible to use all compounds which are able to form complexes with alkaline earth metal ions as cobuilders.

Further usable organic builder substances are also the polycarboxylic acids usable in the form of their sodium salts, polycarboxylic acids being understood to mean those carboxylic acids which bear more than one acid function. For example, these are citric acid, adipic acid, succinic acid, glutaric acid, malic acid, tartaric acid, maleic acid, fumaric acid, sugar acids, aminocarboxylic acids, nitrilotriacetic acid (NTA), unless such a use is objectionable for environmental reasons, and mixtures of these. Preferred salts are the salts of the polycarboxylic acids such as citric acid, adipic acid, succinic acid, glutaric acid, tartaric acid, sugar acids and mixtures of these.

The acids themselves can also be used. As well as their builder effect, the acids typically also have the property of an acidifying component and thus also serve to establish a lower and milder pH of washing and/or cleaning compositions. Particular mention should be made here of citric acid, succinic acid, glutaric acid, adipic acid, gluconic acid and any desired mixtures of these.

C. Bleaches and Bleach Catalysts

Among the compounds which produce $H_2O_2$ in water and serve as bleaches, sodium perborate tetrahydrate and sodium perborate monohydrate are of particular significance. Further usable bleaches are, for example, sodium percarbonate, peroxypyrophosphates, citrate perhydrates, and also $H_2O_2$-producing peracidic salts or peracids, such as perbenzoates, peroxophthalates, diperazelaic acid, phthaloimino peracid or diperdodecanedioic acid. In order to achieve an improved bleaching action in the case of washing at temperatures of 60° C. and below, bleach activators can be incorporated into the washing and cleaning compositions. Bleach activators used may be compounds which, under perhydrolysis conditions, produce aliphatic peroxocarboxylic acids having preferably 1 to 10 carbon atoms, especially 2 to 4 carbon atoms, and/or optionally substituted perbenzoic acid. Suitable substances are those which bear the 0- and/or N-acyl groups of the stated number of carbon atoms and/or optionally substituted benzoyl groups. Preference is given to polyacylated alkylenediamines, especially tetraacetylethylenediamine (TAED), acylated triazine derivatives, especially 1,5-diacetyl-2,4-dioxohexahydro-1,3,5-triazine (DADHT), acylated glycolurils, especially tetraacetylglycoluril (TAGU), N-acylimides, especially N-nonanoylsuccinimide (NOSI), acylated phenolsulphonates, especially nonanoyl- or isononanoyloxybenzenesulphonate (n- or iso-NOBS), carboxylic anhydrides, especially phthalic anhydride, acylated polyhydric alcohols, especially triacetin, ethylene glycol diacetate and 2,5-diacetoxy-2,5-dihydrofuran. In addition to the conventional bleach activators or in their stead, it is also possible for what are called bleach catalysts to be incorporated into the textile treatment compositions. These substances are bleach-boosting transition metal salts or transition metal complexes, for example Mn-, Fe-, Co-, Ru- or Mo-salen complexes or -carbonyl complexes. Also usable as bleach catalysts are Mn, Fe, Co, Ru, Mo, Ti, V and Cu complexes with nitrogen-containing tripod ligands, and Co-, Fe-, Cu- and Ru-ammine complexes.

D. Thickeners

A liquid washing and cleaning composition may comprise a thickener. The thickener may comprise, for example, a polyacrylate thickener, xanthan gum, gellan gum, guar seed flour, alginate, carrageenan, carboxymethyl cellulose, bentonite, wellan gum, carob seed flour, agar agar, tragacanth, gum arabic, pectins, polyoses, starch, dextrins, gelatin and casein. Other usable thickeners are modified natural substances such as modified starches and celluloses, examples here being carboxymethyl cellulose and other cellulose ethers, hydroxyethyl- and -propyl cellulose, and seed flour ethers.

The polyacrylic and polymethacrylic thickeners include, for example, the high molecular weight homopolymers of acrylic acid crosslinked with a polyalkenyl polyether, especially an allyl ether of sucrose, pentaerythritol or propylene (INCI name according to the International Dictionary of Cosmetic Ingredients from The Cosmetic, Toiletry and Fragrance Association (CTFA): Carbomer), which are also referred to as carboxyvinyl polymers. Such polyacrylic acids are available inter alia from 3V Sigma under the Polygel® trade name, e.g. Polygel DA, and from B. F. Goodrich under the Carbopol® trade name, e.g. Carbopol 940 (molecular weight about 4,000,000), Carbopol 941 (molecular weight about 1,250,000) or Carbopol 934 (molecular weight about 3,000,000). In addition, these include the following acrylic acid copolymers: (i) copolymers of two or more monomers from the group of acrylic acid, methacrylic acid and its simple esters formed preferably with C1-4 alkanols (INCI Acrylates Copolymer), which include for instance the copolymers of methacrylic acid, butyl acrylate and methyl methacrylate (CAS name according to Chemical Abstracts Service: 25035-69-2) or of butyl acrylate and methyl methacrylate (CAS 25852-37-3) and which are available for example from Rohm and Haas under the Aculyn® and Acusol® trade names, and also from Degussa (Goldschmidt) under the Tego® Polymer trade name, for example the anionic nonassociative polymers Aculyn 22, Aculyn 28, Aculyn 33 (crosslinked), Acusol 810, Acusol 820, Acusol 823 and Acusol 830 (CAS 25852-37-3); (ii) crosslinked high molecular weight acrylic acid copolymers, which include for instance the copolymers, crosslinked with an allyl ether of sucrose or of pentaerythritol, of C10-30 alkyl acrylates with one or more monomers from the group of acrylic acid, methacrylic acid and their simple esters, formed preferably with C1-4 alkanols (INCI Acrylates/C10-30 Alkyl Acrylate Crosspolymer) and which are available for example from B.F. Goodrich under the Carbopol® trade name, e.g. the hydrophobized Carbopol ETD 2623 and Carbopol 1382 (INCI Acrylates/C10-30 Alkyl Acrylate Crosspolymer), and Carbopol Aqua 30 (formerly Carbopol EX 473).

A further polymeric thickener for use with preference is xanthan gum, a microbial anionic heteropolysaccharide which is produced from *Xanthomonas campestris* and a few other species under aerobic conditions and has a molar mass of 2 to 15 million daltons. Xanthan is formed from a chain having beta-1,4-bonded glucose (cellulose) with side chains. The structure of the subgroups consists of glucose, mannose, glucuronic acid, acetate and pyruvate, and the number of pyruvate units determines the viscosity of the xanthan gum. Another useful thickener is especially a fatty alcohol. Fatty alcohols may be branched or unbranched and of native origin or petrochemical origin. Preferred fatty alcohols have a carbon chain length of 10 to 20 carbon atoms, preferably 12 to 18. Preference is given to using mixtures of different carbon chain lengths, such as tallow fat alcohol or coconut fat alcohol. Examples are Lorol® Spezial (C12-14-ROH) or Lorol® Technisch (C12-18-ROH) (both from Cognis). Preferred liquid washing and cleaning compositions contain, based on the overall composition, 0.01% to 3% by weight and preferably 0.1% to 1% by weight of thickeners. The amount of thickener used is dependent on the type of thickener and the desired degree of thickening.

E. Enzymes

The washing and cleaning compositions may comprise enzymes in encapsulated form and/or directly in the washing and cleaning compositions. Useful enzymes are especially those from the classes of the hydrolases, such as the proteases, esterases, lipases or lipolytic enzymes, amylases, cellulases or other glycosyl hydrolases, hemicellulase, cutinases, beta-glucanases, oxidases, peroxidases, perhydrolases and/or laccases and mixtures of said enzymes. All these hydrolases contribute in the wash to the removal of stains such as protein-, grease- or starch-containing stains and grey discolouration. Cellulases and other glycosyl hydrolases can additionally contribute to colour retention and to increasing the softness of the textile as result of the removal of pilling and microfibrils. Oxidoreductases can also be used for bleaching and/or for inhibiting dye transfer. Of particularly good suitability are enzymatic active ingredients obtained from bacteria strains or fungi such as *Bacillus subtilis, Bacillus licheniformis, Streptomyceus griseus* and *Humicola insolens*. Preference is given to using proteases of the subtilisin type and especially proteases which are obtained from *Bacillus lentus*. Of particular interest are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease and/or lipase-containing mixtures or mixtures with lipolytic enzymes. Examples of such lipolytic enzymes are the known cutinases. Peroxidases or oxidases have also been found to be suitable in some cases.

Suitable amylases especially include alpha-amylases, isoamylases, pullulanases and pectinases. Cellulases used are preferably cellobiohydrolases, endoglucanases and p-glucosidases, which are also called cellobiases, or mixtures of these. Since different cellulase types differ by virtue of their CMCase and avicelase activities, the desired activities can be established through specific mixtures of the cellulases.

The enzymes can be adsorbed onto carriers in order to protect them from premature decomposition. The fraction of the enzymes, of the enzyme liquid formulation(s) or of the enzyme granules directly in washing and cleaning compositions may, for example, be about 0.01% to 5% by weight, preferably 0.12% to about 2.5% by weight.

However, it may also be preferable, for example in the case of special washing and cleaning compositions for consumers having allergies, for the washing and cleaning composition to contain no enzymes.

F. Electrolytes

Electrolytes used from the group of the inorganic salts may be a wide range of very different salts. Preferred cations are the alkali metal and alkaline earth metals; preferred anions are the halides and sulphates. From a production point of view, the use of NaCl or $MgCl_2$ in the washing and cleaning compositions is preferred. The proportion of electrolytes in the washing and cleaning compositions is typically 0.1% to 5% by weight.

G. Solvents

Nonaqueous solvents which can be used in the liquid washing and cleaning compositions come, for example, from the group of the mono- or polyhydric alcohols, alkanolamines or glycol ethers, provided that they are miscible with water in the stated concentration range. The solvents are preferably selected from ethanol, n- or isopropanol, butanols, glycol, propane- or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or -ethyl ether, diisopropylene glycol monomethyl or -ethyl ether, methoxy-, ethoxy- or butoxytriglycol, 1-butoxyethoxy-2-propanol, 3-methyl-3-methoxybutanol, propylene glycol t-butyl ether, and mixtures of these solvents. Nonaqueous solvents can be used in the liquid washing and cleaning compositions in amounts between 0.5% and 15% by weight, but preferably below 12% by weight and especially below 9% by weight.

H. Viscosity

The viscosity of the washing and cleaning compositions in liquid form can be measured by customary standard methods (for example Brookfield viscometer LVT-II at 20 rpm and 20° C., spindle 3) and for liquid washing compositions is preferably in the range from 500 to 5000 mPas. Preferably, liquid washing and cleaning compositions have viscosities of 700 to 4000 mPas, particular preference being given to values between 1000 and 3000 mPas. The viscosity of fabric softeners is preferably 20 to 4000 mPas, particular preference being given to values between 40 and 2000 mPas. The viscosity of fabric softeners is especially preferably 40 to 1000 mPas.

I. pH Modifiers

In order to bring the pH of the liquid washing and cleaning compositions into the desired range, the use of pH modifiers may be appropriate. It is possible here to use all known acids or alkalis, unless their use is ruled out for application-related or environmental reasons or for reasons of consumer protection. Typically, the amount of these modifiers does not exceed 7% by weight of the total formulation. The pH of liquid washing and cleaning compositions is preferably between 4 and 10 and preferably between 5.5 and 8.5. The pH of liquid fabric softeners is preferably between 1 and 6 and preferably between 1.5 and 3.5.

J. Dyes

In order to improve the aesthetic impression of the textile treatment compositions, they may be coloured with suitable dyes. Preferred dyes, the selection of which does not present the person skilled in the art with any difficulty, have a high storage stability and insensitivity to the other ingredients of the washing and cleaning compositions and to light, and no marked substantivity towards textile fibres, so as not to stain them.

K. Antiredeposition Agents

Suitable soil release polymers, which are also referred to as "antiredeposition agents", are for example nonionic cellulose ethers such as methyl cellulose and methylhydroxypropyl cellulose having a proportion of methoxy groups of 15% to 30% by weight and of hydroxypropyl groups of 1% to 15% by weight, based in each case on the nonionic cellulose ethers, and also the polymers, known from the prior art, of phthalic acid and/or terephthalic acid or of derivatives thereof, especially polymers of ethylene terephthalates and/or polyethylene and/or polypropylene glycol terephthalates or anionically and/or nonionically modified derivatives of these. Suitable derivatives include the sulphonated derivatives of phthalic acid and terephthalic acid polymers.

L. Optical Brighteners

Optical brighteners (so-called "whiteners") can be added to the washing and cleaning compositions in order to eliminate greying and yellowing of the treated textile fabrics. These substances become attached to the fibres and bring about a lightening and simulated bleaching effect by converting invisible ultraviolet radiation to visible long-wave light, the ultraviolet light absorbed from the sunlight being emitted as slightly bluish fluorescence and producing pure white with the yellow shade of the greyed or yellowed laundry. Suitable compounds come for example from the substance classes of the 4,4'-diamino-2,2'-stilbenedisulphonic acids (flavone acids), 4,4'-distyrylbiphenyls, methylumbelliferones, coumarins, dihydroquinolinones, 1,3-diarylpyrazolines, naphthalimides, benzoxazole, benzisoxazole and benzimidazole systems, and also the pyrene derivatives substituted by heterocycles. The optical brighteners are usually used in amounts between 0% and 0.3% by weight, based on the finished washing and cleaning composition.

M. Greying Inhibitors

Greying inhibitors have the task of keeping the dirt detached from the fibres suspended in the liquor and hence of preventing reattachment of the dirt. Suitable for this purpose are water-soluble colloids, usually organic in nature, for example size, gelatin, salts of ethersulphonic acids of starch or of cellulose or salts of acidic sulphuric acid esters of cellulose or of starch. Also suitable for this purpose are water-soluble polyamides containing acidic groups. In addition, it is possible to use soluble starch preparations and starch products other than those specified above, for example degraded starch, aldehyde starches etc. It is also possible to use polyvinylpyrrolidone. However, preference is given to using cellulose ethers such as carboxymethyl cellulose (sodium salt), methyl cellulose, hydroxyalkyl cellulose and mixed ethers such as methylhydroxyethyl cellulose, methylhydroxypropyl cellulose, methylcarboxymethyl cellulose and mixtures thereof in amounts of 0.1% to 5% by weight, based on the washing and cleaning compositions.

N. Anticrease Agents

Since textile fabrics, especially made of rayon, spun rayon, cotton and mixtures thereof, can have a tendency to crease because the individual fibres are sensitive to bending, folding, pressing and squashing transverse to the fibre direction, the washing and cleaning compositions may contain synthetic anticrease agents. These include, for example, synthetic products based on fatty acids, fatty acid esters, fatty acid amides, fatty acid alkylol esters, fatty acid alkylolamides or fatty alcohols, which have usually been reacted with ethylene oxide, or products based on lecithin or modified phosphoric acid esters.

O. Active Antimicrobial Ingredients

To control microorganisms, the washing and cleaning compositions may contain active antimicrobial ingredients. A distinction is made here, according to the antimicrobial spectrum and mechanism of action, between bacteriostats and bacteriocides, fungistats and fungicides, etc. Important substances from these groups are, for example, benzalkonium chlorides, alkylarylsulphonates, halophenols and phenylmercuric acetate, although it is also possible to dispense entirely with these compounds in the case of the washing and cleaning compositions according to the invention.

P. Preservatives

The washing and cleaning compositions according to the invention may contain preservatives, preference being given to using only those which have only a slight skin-sensitizing potential, if any. Examples are sorbic acid and its salts, benzoic acid and its salts, salicylic acid and its salts, phenoxyethanol, 3-iodo-2-propynyl butylcarbamate, sodium N-(hydroxymethyl)glycinate, biphenyl-2-ol, and mixtures thereof. A suitable preservative is the solvent-free aqueous combination of diazolidinylurea, sodium benzoate and potassium sorbate (available as Euxyl® K 500 from Schülke and Mayr), which can be used in a pH range up to 7. Preservatives based on organic acids and/or salts thereof are particularly suitable for preserving the skin-friendly washing and cleaning compositions according to the invention.

Q. Antioxidants

In order to prevent unwanted changes to the washing and cleaning compositions and/or the treated textile fabrics caused by the action of oxygen and other oxidative processes, the washing and cleaning compositions may contain antioxidants. This compound class includes, for example, substituted phenols, hydroquinones, catechols and aromatic amines, and also organic sulphides, polysulphides, dithiocarbamates, phosphites, phosphonates and vitamin E.

R. Antistats

Increased wear comfort can result from the additional use of antistats which are additionally added to the washing and cleaning compositions. Antistats increase surface conductivity and hence enable improved dissipation of charges formed. Antistats are generally substances having at least one hydrophilic molecular ligand and give a more or less hygroscopic film on the surfaces. These usually interface-active antistats can be divided into nitrogen-containing antistats (amines, amides, quaternary ammonium compounds), phosphorus-containing antistats (phosphoric acid esters) and sulphur-containing antistats (alkylsulphonates, alkylsulphates). Lauryl-(or stearyl-)dimethylbenzylammonium chlorides are suitable as antistats for textile fabrics and/or as an additive to washing and cleaning compositions, in which case a conditioning effect is additionally achieved.

S. Foam Inhibitors

To improve the rewettability of the treated textile fabrics and to facilitate ironing of the treated textile fabrics, silicone derivatives, for example, can be used in the textile treatment compositions. These additionally improve the rinse-out performance of the washing and cleaning compositions by virtue of their foam-inhibiting properties. Preferred silicone derivatives are, for example, polydialkyl- or alkylarylsiloxanes in which the alkyl groups have one to five carbon atoms and have been entirely or partly fluorinated. Preferred silicones are polydimethylsiloxanes, which may optionally have been derivatized and are then amino-functional or quaternized and/or have Si—OH, Si—H and/or Si—Cl bonds. The viscosities of the preferred silicones at 25° C. are in the range between 100 and 100,000 mPas, where the silicones may be used in amounts between 0.2% and 5% by weight, based on the overall washing and cleaning composition.

T. UV Absorbers

Finally, the washing and cleaning compositions may also contain UV absorbers, which become attached to the treated textile fabrics and improve the light resistance of the fibres. Compounds which have these desired properties are, for example, the compounds effective as a result of radiationless deactivation and derivatives of benzophenone having substituents in the 2 and/or 4 position. Additionally suitable are also substituted benzotriazoles, 3-phenyl-substituted acrylates (cinnamic acid derivatives), optionally with cyano groups in the 2 position, salicylates, organic nickel complexes, and natural products such as umbelliferone and endogeneous urocanic acid.

U. Heavy Metal Complexing Agents

In order to avoid the decomposition of certain washing composition ingredients catalysed by heavy metals, it is possible to use substances which complex heavy metals. Suitable heavy metal complexing agents are, for example, the alkali metal salts of ethylenediaminetetraacetic acid (EDTA) or of nitrilotriacetic acid (NTA), and also alkali metal salts of anionic polyelectrolytes such as polymaleates and polysulphonates. A preferred class of complexing agents is that of the phosphonates, which are present in preferred textile treatment compositions in amounts of 0.01% to 2.5% by weight, preferably 0.02% to 2% by weight and especially of 0.03% to 1.5% by weight. These preferred compounds especially include organophosphonates, for example 1-hydroxyethane-1,1-diphosphonic acid (HEDP), aminotri(methylenephosphonic acid) (ATM P), diethylenetriamine-penta-(methylenephosphonic acid) (DTPMP or DETPMP), and 2-phosphonobutane-1,2,4-tricarboxylic acid (PBS-AM), which are usually used in the form of their ammonium or alkali metal salts.

Production of the Preparations

The liquid washing compositions are produced by means of customary and known methods and processes in which, for example, the constituents are simply mixed in stirred tanks, appropriately with an initial charge of water, non-aqueous solvents and surfactants, and addition of the other constituents in portions. It is thus possible to produce liquid washing and cleaning compositions by initially charging the acidic components, for example the linear alkylsulphonates, citric acid, boric acid, phosphonic acid, the fatty alcohol ether sulphates, etc., and the nonionic surfactants. The solvent component is preferably also added at this point, although the addition can also take place at a later time. The polyacrylate is added to these components. Subsequently, a base is added, for example NaOH, KOH, triethanolamine or monoethanolamine, followed by the fatty acid, if present. Thereafter, the remaining ingredients and the remaining solvents of the aqueous liquid washing and cleaning compositions are added to the mixture and the pH is adjusted to about 8.5. Finally, the particles to be dispersed can be added and distributed homogeneously in the aqueous liquid washing and cleaning composition by mixing.

The compositions according to the invention are preferably washing compositions suitable both for manual and machine washing, especially of textiles. They may also be washing or cleaning compositions for the industrial sector or for the domestic sector. Cleaning compositions can also be used for example for cleaning of hard surfaces. These may for example be dishwashing detergents which are used for the manual or machine cleaning of dishware. They may also be customary industrial or domestic detergents with which hard surfaces such as furniture surfaces, wall and floor tiles, and wall and floor coverings are cleaned. As well as dishware, hard surfaces also include all other hard surfaces, especially made of glass, ceramic, plastic or metal, in the home and in industry.

These washing and cleaning compositions are preferably liquid formulations which may be solutions, emulsions, dispersions, suspensions, microemulsions, gels or pastes.

In the form of surface treatment compositions, the composition may accordingly comprise customary ingredients of cleaning compositions in customary amounts. For example, surface treatment compositions in the form of cleaning compositions may comprise alkyl ether sulphates, alkyl- and/or arylsulphonates, alkyl sulphates, amphoteric surfactants, anionic surfactants, nonionic surfactants, cationic surfactants, solvents, thickeners, dicarboxylic acids (dicarboxylic salts) and further auxiliaries and additives.

Some of these additional ingredients have already been elucidated in detail above and likewise apply here to use in cleaning compositions (see nonionic surfactants, for example). Auxiliaries and additives which may be present in amounts of typically not more than 5% by weight—especially in manual dishwashing compositions and cleaning compositions for hard surfaces—are especially UV stabilizers, perfume, pearlizing agents (INCI Opacifying Agents; for example glycol distearate, e.g. Cutina® AGS from Henkel KGaA, or mixtures containing the latter, for example the Euperlans® from Henkel KGaA), SRPs (soil repellent polymers), PEG terephthalates, dyes, bleaches (e.g. hydrogen peroxide), corrosion inhibitors, preservatives (e.g. 2-bromo-2-nitropropane-1,3-diol, also referred to in industry as bronopol (CAS 52-51-7), which is commercially available for example as Myacide® BT or as Boots Bronopol BT from Boots), and skinfeel-improving or care additives (e.g. dermatologically active substances such as vitamin A, vitamin B2, vitamin B12, vitamin C, vitamin E, D-panthenol, sericerin, collagen partial hydrolysate, various plant protein partial hydrolysates, protein hydrolysate fatty acid condensates, liposomes, polypropylene glycol, Nutrilan™ Chitosan™, cholesterol, vegetable and animal oils, for example lecithin, soybean oil, etc., plant extracts, for example aloe vera, azulene, hamamelis extracts, algae extracts, etc., allantoin, A.H.A. complexes). To enhance performance, small amounts of enzymes may be used. Preference is given to proteases (e.g. BLAP (Henkel), savinase (NOVO), durazym (NOVO), Maxapemm, etc.), amylases (e.g. fermamyl (NOVO), etc.), lipases (e.g. lipolase (NOVO), etc.), peroxidases, gluconases, cellulases, mannases, etc., in amounts of preferably 0.001% to 1.5% by weight and more preferably less than 0.5% by weight.

Capsules

The stabilization system of the present invention is applied to capsules containing active ingredients and other ingredients. The capsules in the present invention may be particles, microcapsules or speckles, but also granules, compounds and fragrance beads, preference being given to microcapsules or speckles.

The term "microcapsules" is understood to mean aggregates containing at least one solid or liquid core surrounded by at least one continuous shell, especially a shell of polymer(s). Typically, these are finely dispersed liquid or solid phases coated with film-forming polymers, the production of which involves precipitating the polymers, after emulsification and coacervation or interfacial polymerization, on the material to be coated. The microscopically small capsules can be dried like powders. Also known in addition to single-core microcapsules are multi-core aggregates, also called microspheres, which contain two or more cores distributed in the continuous shell material. Single- or multicore capsules may additionally be encased by an additional second, third, etc. shell. Preference is given to single-core microcapsules having a continuous shell. The shell may consist of natural, semisynthetic or synthetic materials. Natural shell materials are, for example, gum arabic, agar agar, agarose, maltodextrins, alginic acid or salts thereof, e.g. sodium alginate or calcium alginate, fats and fatty acids, cetyl alcohol, collagen, chitosan, lecithins, gelatin, albumin, shellac, polysaccharides such as starch or dextran, sucrose and waxes. Semisynthetic shell materials include chemically modified celluloses, especially cellulose esters and ethers, e.g. cellulose acetate, ethyl cellulose, hydroxypropyl cellulose, hydroxypropyl methylcellulose and carboxymethyl cellulose, and also starch derivatives, especially starch ethers and esters. Synthetic shell materials are, for example, polymers such as polyacrylates, polyamides, polyvinyl alcohol or polyvinylpyrrolidone.

Preferably, the capsules are microcapsules having a water-insoluble wall material, preferably polyurethanes, polyolefins, polyamides, polyesters, polysaccharides, epoxy resins, silicone resins and/or polycondensation products of carbonyl compounds and compounds containing NH groups.

The procedure in microcapsule production as such is well known to those skilled in the art. Suitable processes for microcapsule production are familiar to those skilled in the art and are described, for example, in U.S. Pat. No. 3,870,52, in U.S. Pat. No. 3,516,941, in U.S. Pat. No. 3,415,758 or else in EP 0026914 A1. The latter describes, for example, microcapsule production by acid-induced condensation of melamine-formaldehyde precondensates and/or the $C_1$-$C_4$-alkyl ethers thereof in water with the hydrophobic material that forms the capsule core dispersed therein, in the presence of a protective colloid.

It is possible with preference to use, for example, melamine-urea-formaldehyde microcapsules or melamine-formaldehyde microcapsules or urea-formaldehyde microcapsules, obtainable, for example, from 3M Corporation or BASF.

Suitable microcapsules are also described, for example, in WO 2001/049817 A2.

The microcapsules are obtainable by processes known in the prior art, the processes of the greatest significance being coacervation and interfacial polymerization. Microcapsules used may be all the surfactant-stable microcapsules supplied on the market, for example the following commercial products (with the shell material stated in brackets in each case): Hallcrest Microcapsules (gelatin, gum arabic), Coletica Thalaspheres (maritime collagen), Lipotec Millicapsules (alginic acid, agar agar), Induchem Unispheres (lactose, microcrystalline cellulose, hydroxypropyl methylcellulose); Unicerin C30 (lactose, microcrystalline cellulose, hydroxypropyl methylcellulose), Kobo Glycospheres (modified starch, fatty acid esters, phospholipids), Softspheres (modified agar agar) and Kuhs Probiol Nanospheres (phospholipids).

Alternatively, it is also possible to use particles which do not have core-shell structure, but in which the active ingredient is distributed in a matrix of a matrix-forming material. Such particles are also referred to as "speckles".

A preferred matrix-forming material is alginate. For production of alginate-based speckles, an aqueous alginate solution also containing the active ingredient(s) to be incorporated is dropletized and then hardened in a precipitation bath containing $Ca^{2+}$ ions or $Al^{3+}$ ions. It may be advantageous for the alginate-based speckles then to be washed with water and then washed in an aqueous solution containing a complexing agent, in order to wash out free $Ca^{2+}$ ions or free $Al^{3+}$ ions which can enter into unwanted interactions with ingredients of the liquid washing and cleaning composition, for example the fatty acid soaps. Subsequently, the alginate-based speckles are washed once more with water in order to remove excess complexing agent. Alternatively, rather than alginate, it is possible to use other matrix-forming materials. Examples of matrix-forming materials include polyethylene glycol, polyvinylpyrrolidone, polymethacrylate, polylysine, poloxamer, polyvinyl alcohol, polyacrylic acid, polyethylene oxide, polyethoxyoxazoline, albumin, gelatin, acacia, chitosan, cellulose, dextran, Ficoll®, starch, hydroxyethyl cellulose, hydroxypropyl cellulose, hydroxypropyl methylcellulose, hyaluronic acid, carboxymethyl cellulose, deacetylated chitosan, dextran sulphate and derivatives of these materials. Matrix formation in the case of these materials is effected, for example, via gelation, polyanion-polycation interactions or polyelectrolyte-metal ion interactions, and is well known in the prior art, just like the production of particles with these matrix-forming materials.

The particles can be dispersed in a stable manner in the aqueous liquid washing and cleaning compositions. "Stable" means that the compositions are stable at room temperature and 40° C. over a period of at least 4 weeks and preferably of at least 6 weeks, without creaming or sedimentation of the compositions.

Within the scope allowed by production, the capsules may have any desired shape, but they are preferably approximately spherical. The diameter thereof along the greatest spatial dimension may, according to the components present in the interior thereof and the use, be between 0.1 nm (not visually perceptible as a capsule) and 1000 μm. Microcapsules usable with preference have mean diameters in the range from 0.1 to 1000 μm, preferably between 1 and 100 μm, especially between 5 and 75 μm, e.g. 10-50 μm. The shell of the microcapsules that surrounds the core or (filled) cavity has an average thickness in the range between about 75 and 300 nm, preferably between about 80 nm and about 250 nm, especially between about 90 nm and about 200 nm. Microcapsules that fulfil the aforementioned parameters are stabilized particularly efficiently in the washing and cleaning composition and thus show good results in the context of the invention.

Within the capsules, it is possible to enclose sensitive, chemically or physically incompatible and volatile components (=active ingredients) of the liquid washing and cleaning composition in a storage- and transport-stable form. Examples of components present within the capsules may be optical brighteners, surfactants, complexing agents, bleaches, bleach activators, dyes and fragrances, antioxidants, builders, enzymes, enzyme stabilizers, active antimicrobial ingredients, greying inhibitors, antiredeposition agents, pH modifiers, electrolytes, foam inhibitors and UV absorbers. In addition, the capsules of the aqueous liquid washing and cleaning compositions may contain cationic surfactants, vitamins, proteins, preservatives, washing power enhancers or pearlescent agents. The contents of the capsules may be solids or liquids in the form of solutions or emulsions or suspensions.

The active ingredients are typically released from the capsules during the use of the compositions that comprise them through destruction of the shell or the matrix as a result of mechanical, thermal, chemical or enzymatic action. In a preferred embodiment of the invention, the liquid washing and cleaning compositions contain identical or different capsules in amounts of 0.01% to 10% by weight, especially 0.03% to 5% by weight and exceptionally preferably 0.05% to 2.5% by weight.

The inventive liquid washing and cleaning compositions containing capsules are cloudy and have no sediment.

The present invention likewise encompasses a process for producing washing and cleaning compositions, in which a mixture of different fragrances in encapsulated form and at least one rheology modifier selected from the group consisting of hydrogenated castor oils, hydrogenated castor waxes, sheet silicates, polyacrylates and mixtures thereof is incorporated into a washing and cleaning composition.

The invention further encompasses a process for producing washing and cleaning compositions, wherein the rheology modifier composed of castor oils and/or castor waxes, in a first step, a), is stirred in in a solvent. Suitable solvents are aqueous solutions such as surfactant solutions and/or alcoholic solutions. They are preferably solvents which are typical of washing and cleaning compositions and have already been described above. Preferably, the total amount of rheology modifier is stirred in in the solvent, and then, in a second step, b), the mixture is heated up to the melting point of the rheology modifier. Preferably, the mixture is heated up to at least 85° C., preferably from 85° C. to 90° C. or from 85° C. to 88° C. The rheology modifier is then preferably in molten form in the solvent at these temperatures. Subsequently, in a step c), the mixture is cooled down to 40° C. while stirring and then, in a step d), the mixture is added to a washing or cleaning composition formulation.

The process steps can of course also be modified, for example by stirring in only a portion of the rheology modifier in the solvent, heating it and thus pre-dissolving it. Further modifications may lie in the duration of the heating period and the cooling period and in the stirring speed of the mixture, but these lead to the same result, namely a mixture with a pre-dissolved rheology modifier. This mixture can of course either be added to a washing or cleaning composition formulation or, conversely, the washing or cleaning composition formulation can be added to the mixture. The sequence of addition is not subject to any restrictions here.

The present invention likewise encompasses a composition comprising a mixture of a sheet silicate with a polyacrylate for stabilization of fragrance capsules in washing and cleaning compositions.

The sheet silicate is a mixture having the following composition: about 40% to 60% by weight of $SiO_2$, about 20% to 30% by weight of MgO, about 0.3% to 0.9% by weight of $Li_2O$, about 1.5% to 3% by weight of $Na_2O$, such a sheet silicate preferably having a BET of about 345 to 390 $m^2/g$. Preferably suitable silicates consist of a mixture of several components, preferably about 50% to 60% by weight of $SiO_2$, 25% to 28% by weight of MgO, about 0.5% to 0.8% by weight of $Li_2O$, about 2.0% to 2.8% by weight of $Na_2O$, and preferably have a BET of about 355 to 380 $m^2/g$. Very particular preference is given to sheet silicates consisting of 59.5% by weight of $SiO_2$, 27.5% by weight of MgO, 0.8% by weight of $Li_2O$ and 2.8% of $Na_2O$ and having a BET of 370 $m^2/g$ and a pH of 9.8 (2% suspension). Compositions of this kind are known by the Laponite® trade name from Rockwood; for the composition according to the invention, particular preference is given to the Laponite® OG or RD product.

Preferably, the polyacrylate is a component selected from the group consisting of HASE polymer, ASE polymer, latex polyacrylate, anionic polyacrylate emulsion and polyacrylate dispersion. In a preferred embodiment, the HASE polymer is Acrylates/Beneth-25 Methacrylate Copolymer, preferably the product Thixcin®, and the latex polyacrylate is preferably Polygel W 301, and the polyacrylate emulsion is preferably Polygel W400, and the polyacrylate dispersion is preferably Carbopol® Aqua 30 Polymer.

Such mixtures of Laponite® OG with polyacrylates have marked synergistic effects in the stabilization of capsules having an average particle size distribution from 0.1 nm to 1000 μm; the capsules preferably have an average particle size distribution from 1 to 100 μm, more preferably 5 to 75 μm, most preferably 10 to 50 μm.

EXAMPLES

The invention is elucidated in detail by the examples which follow. All figures are given in per cent by weight, based in each case on the overall composition.

Example 1

Production of the Example Formulations with Fragrance Capsules a) Stabilization System H1:

Thixcin® is added in an amount of 0.2%-0.4% in a mixture of sodium benzene-sulphonate and water, and heated to at least 85° C. Subsequently, the mixture is stirred until the temperature of about 40° C. has been attained. Finally, the rest of the formulation is added (formulation in Table 1).

b) Stabilization Systems H2 to H5:

HASE polyacrylate or ASE polyacrylate (Novethix™ L10 Polymer, Polygel W301, Polygel W400, Carbopol® Aqua 30 Polymer) is stirred into the formulation (Table 1) in an amount of 0.2%-1.5% in combination with lithium magnesium sodium silicate (Laponite® OG), in an amount of 0.1%-0.3%.

c) Comparative System V1:

The base formulation (Table 1) is used without further additions.

d) Comparative Systems V2 to V5:

HASE polyacrylate or ASE polyacrylate (Novethix™ L10 Polymer, Polygel W301, Polygel W400, Carbopol® Aqua 30 Polymer) is stirred into the formulation (Table 1) in an amount of 0.2%-1.5% without any lithium magnesium sodium silicate (Laponite® OG).

Example 2

Storage Test

The washing composition samples were stored in 30 ml glass bottles at 23° C., 5° C. and 40° C. After 1, 2, 3 and 4 weeks, the samples were assessed visually for separation of the (fragrance) capsules. If separations were observed, the formulation was rated as unstable. If no separations were observed, the sample was rated as stable.

The results can be found in Table 2. In this table, (+)=stable and (−)=unstable.

Example 3

Rheometer Measurement

The rheological properties of the samples were measured with the aid of a rheometer.

Measurement conditions: 23° C., cone/plate C60/2° Ti, CR log 0.01 1/s-40.00 1/s, CR log 40.00 1/s-0.01 1/s.

The results can be found in FIG. 1:

The lower curve shows the comparative experiment (identified as V 1.1) and the upper curve shows the inventive formulation (identified as V 3.2).

The rheology measurement shows the rise in the force required at the start and the drop in the force toward the middle of the measurement, followed by another rise towards the end. This shows that the sample has a high viscosity during the rest phase, which falls rapidly as a result of application of force (shear) and is re-established in the subsequent rest phase.

TABLE 1

Base formulation for washing compositions

| Base formulation | |
|---|---|
| Sodium benzenesulphonate (about 50%) | 10.00% |
| Fatty alcohol ethoxylate C12-18 9EO | 3.00% |
| Sodium lauryl ether sulphate (about 28%) | 40.00% |
| Sodium lauryl sulphate (about 35%) | 10.00% |
| 1,2-Propylene glycol | 3.00% |
| Phosphonate (about 30%) | 2.00% |
| Ethanol 96% | 1.50% |
| Disodium citrate | 2.00% |
| Perfume | 0.80% |
| SymCap ® fragrance capsules | 0.50% |
| Water | Ad to 100 |

TABLE 2

Storage test of the washing composition samples (amounts used in %)

| | Example | | | | | | | | | |
|---|---|---|---|---|---|---|---|---|---|---|
| | V1 | H1 | V2 | H2 | V3 | H3 | V4 | H4 | V5 | H5 |
| Novethix-L10 Polymer (Lubrizol) | | | 2 | 2 | | | | | | |
| Polygel W 301 (3V) | | | | | 2 | 2 | | | | |
| Polygel W 400 (3V) | | | | | | | 2 | 2 | | |
| Carbopol Aqua 30 (Lubrizol) | | | | | | | | | 2 | 2 |
| Laponite OG (Rockwood) | | | | 0.15 | | 0.15 | | 0.15 | | 0.15 |
| Thixcin R (Elementis) | 0.2 | 0.2 | | | | | | | | |
| Result | (−) | (+) | (−) | (+) | (−) | (+) | (−) | (+) | (−) | (+) |

TABLE 3

Fragrance formulation of the perfume of the base formulation

| Component | Proportion |
|---|---|
| ALDEHYDE C11 UNDECYLENIC | 2.0% |
| ALDEHYDE C12 MNA | 6.0% |
| ALLYLCYCLOHEXYL PROPIONATE | 2.0% |
| ALLYL HEPTANOATE | 6.0% |
| ANETHOL NAT. EX STERNANIS | 0.5% |
| ANISALDEHYDE PURE | 6.5% |
| BORNEOL CRIST. | 2.0% |
| DAMASCONE DELTA | 4.5% |
| EUCALYPTOL NAT. | 6.0% |
| FENCHELOEL AROMA TYP SUESS NAT. | 4.5% |
| ISOBORNYL ACETATE | 24.0% |
| CAMPHOR DL | 8.0% |
| MANZANATE | 4.0% |
| NEROLIN YARA YARA KRIST. | 4.0% |
| NEROLIONE | 2.0% |
| ORANGE OIL BRAS. | 6.0% |
| PATCHOULIOEL ENTF. | 2.0% |
| STYROLYLACETATE | 6.0% |
| VERTOCITRAL | 4.0% |

The invention claimed is:

1. A method for the production of washing and cleaning compositions, comprising the steps of:

a) stirring a rheology modifier selected from the group consisting of 2,3-bis(12-hydroxyoctadecanoloxy)propyl 12-hydroxyoctadecanoate, or a mixture of a sheet silicate with a polyacrylate selected from the group consisting of HASE polymer, ASE polymer, latex polyacrylate, anionic polyacrylate emulsion and polyacrylate dispersion, into a solvent, b) heating up the mixture of rheology modifier and solvent to the melting point of the rheology modifier, c) cooling down the mixture to 40 degrees centigrade while stirring, and d) adding 0.1 percent by weight to 50 percent by weight of the at least one rheology modifier to a washing or cleaning composition formulation comprising fragrance capsules having an average particle size distribution of from 10 to 50 μm.

2. The method according to claim 1, wherein the fragrance capsules contain fragrances selected from the group consisting of the aldehyde fragrances, ketone fragrances, prodrugs and mixtures thereof.

3. The method of claim 1 wherein the rheology modifier comprises a mixture of a sheet silicate with a polyacrylate selected from the group consisting of HASE polymer, ASE polymer, latex polyacrylate, anionic polyacrylate emulsion and polyacrylate dispersion and wherein the sheet silicate has the composition of 40% to 60% by weight of $SiO_2$, 20% to 30% by weight of MgO, 0.3% to 0.9% by weight of $Li_2O$, 1.5% to 3% by weight of $Na_2O$, and a BET of 345 to 390 $m^2/g$.

4. The method of claim 1, wherein the rheology modifier is a mixture of a sheet silicate with a polyacrylate which is a HASE polymer, and wherein the HASE polymer is an acrylates/beneth-25 methacrylate copolymer.

5. The method of claim 1 wherein the washing and cleaning composition formulation further includes ingredients for care, conditioning and/or aftertreatment of textiles, selected from the group consisting of surfactants, builders, bleaches, bleach activators, thickeners, enzymes, electrolytes, pH modifiers, dyes, foam inhibitors, antiredeposition agents, optical brighteners, greying inhibitors, anti-crease agents, active antimicrobial ingredients, preservatives, antioxidants, antistats, UV absorbers, and heavy metal complexing agents.

6. The method of claim 2 wherein the ketone fragrances are selected from the group consisting of buccoxime, isojasmone, methyl beta-naphthyl ketone, musk indanone, Tonalid/musk plus, alpha-damascone, beta-damascone, delta-damascone, isodamascone, damascenone, damarose, methyl dihydrojasmonate, menthone, carvone, camphor, fenchone, alpha-ionone, beta-ionone, dihydro-beta-ionone, gamma-methylionone (so-called), fleuramone, dihydrojasmone, cisjasmone, Iso-E-Super, methyl cedrenyl ketone or methyl-cedrylone, acetophenone, methylacetophenone, para-methoxyacetophenone, methyl beta-naphthyl ketone, benzylacetone, benzophenone, para-hydroxyphenylbutanone, celery ketone or livescone, 6-isopropyldecahydro-2-naphthone, dimethyloctenone, Freskomenthe, 4-(1-ethoxyvinyl)-3,3,5,5-tetramethylcyclohexanone, methylheptenone, 2-(2-(4-methyl-3-cyclohexen-1-yl)propyl)cyclopentanone, 1-(p-menthen-6(2)-yl)-1-propanone, 4-(4-hydroxy-3-methoxyphenyl)-2-butanone, 2-acetyl-3,3-dimethylnorbomane, 6,7-dihydro-1,1,2,3,3-pentamethyl-4(5H)-indanone, 4-damascol, dulcinyl or cassione, gelsone, hexalone, isocyclemone E, methyl-cyclocitrone, methylavender ketone, orivone, para-tert-butylcyclohexanone, verdone, delphone, muscone, neobutenone, plicatone, veloutone, 2,4,4,7-tetramethyloct-6-en-3-one, tetramerane, hedione and mixtures thereof.

7. The method of claim 2 wherein the ketone fragrances are selected from the group consisting of alpha-damascone, delta-damascone, isodamascone, carvone, gamma-methylionone, Iso-E-Super, 2,4,4,7-tetramethyloct-6-en-3-one, benzylacetone, beta-damascone, damascenone, methyl dihydrojasmonate, methylcedrylone, hedione and mixtures thereof.

8. The method of claim 2 wherein the aldehyde fragrances are selected from the group consisting of melonal, triplal, ligustral, adoxal, anisaldehyde, cymal, ethylvanillin, florhydral, floralozone, helional, heliotropin, hydroxycitronellal, koavone, lauryl aldehyde, canthoxal, lyral, lilial, adoxal, anisaldehyde, cumal methylnonylacetaldehyde, citronellal, citronellyloxy-acetaldehyde, cyclamen aldehyde, bourgeonal, p,t-bucinal, phenylacetaldehyde, undecylenealdehyde, vanillin; 2,6,10-trimethyl-9-undecenal, 3-dodecen-1-al, alpha-n-amylcinnamaldehyde, 4-methoxybenzaldehyde, benzaldehyde, 3-(4-tert-butylphenyl)propanal, 2-methyl-3-(para-methoxyphenyl)propanal, 2-methyl-4-(2,6,6-trimethyl-2(1)-cyclohexen-1-yl)butanal, 3-phenyl-2-propenal, cis/trans-3,7-dimethyl-2,6-octadien-1-al, 3,7-dimethyl-6-octen-1-al, [(3,7-dimethyl-6-octenyl)oxy]acetaldehyde, 4-isopropylbenzyl aldehyde, 1,2,3,4,5,6,7,8-octahydro-8,8-dimethyl-2-naphthaldehyde, 2,4-dimethyl-3-cyclohexene-1-carboxyaldehyde, 2-methyl-3-(isopropylphenyl)propanal, decyl aldehyde, 2,6-dimethyl-5-heptenal; 4-(tricyclo[5.2.1.0$^{(2,6)}$]decylidene-8)-butanal; octahydro-4,7-methano-1H-indenecarboxaldehyde; 3-ethoxy-4-hydroxybenzaldehyde, para-ethyl-alpha,alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexenecarboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctan-1-al, 2-methylundecanal, 2-methyldecanal, 1-nonanal, 1-octanal, 2,6,10-trimethyl-5,9-undecadienal, 2-methyl-3-(4-tert-butyl)propanal, 3-(4-ethylphenyl)-2,2-dimethylpropanal, 3-(4-methoxyphenyl)-2-methylpropanal, methylnonylacetaldehyde, 2-phenylpropan-1-al, 3-phenylprop-2-en-1-al, 3-phenyl-2-pentylprop-2-en-1-al, 3-phenyl-2-hexylprop-2-enal, 3-(4-isopropylphenyl)-2-methylpropan-1-al, 3-(4-ethylphenyl)-2,2-dimethylpropan-1-al, 3-(4-tert-butylphenyl)-2-methylpropanal, 3-(3,4-methylenedioxyphenyl)-2-methylpropan-1-al, 3-(4-ethylphenyl)-2,2-dimethylpropanal, 3-(3-isopropylphenyl)butan-1-al, 2,6-dimethylhept-5-en-1-al, dihydrocinnamaldehyde, 1-methyl-4-(4-methyl-3-pentenyl)-3-cyclohexene-1-carboxaldehyde, 5- or 6-methoxyhexahydro-4,7-methanoindane-1- or -2-carboxyaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxyaldehyde, 7-hydroxy-3,7-dimethyloctanal; trans-4-decenal, 2,6-nonadienal, para-tolylacetaldehyde; 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexenecarboxaldehyde, 3,7-dimethyl-2-methylene-6-octenal, phenoxyacetaldehyde; 5,9-dimethyl-4,8-decadienal, peony aldehyde (6,10-dimethyl-3-oxa-5,9-undecadien-1-al), hexahydro-4,7-methanoindane-1-carboxaldehyde, octanal, 2-methyloctanal, alpha-methyl-4-(1-methylethyl)benzeneacetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propylbicyclo[2.2.1]hept-5-ene-2-carbaldehyde, 9-decenal, 3-methyl-5-phenyl-1-pentanal, methylnonylacetaldehyde, 1-p-menthene-q-carboxaldehyde, citral or mixtures thereof, lilial citral, 1-decanal, n-undecanal, n-dodecanal, florhydral, 2,4-dimethyl-3-cyclohexene-1-carboxaldehyde, 4-methoxybenzaldehyde, 3-methoxy-4-hydroxybenzaldehyde, 3-ethoxy-4-hydroxybenzaldehyde, 3,4-methylenedioxybenzaldehyde and 3,4-dimethoxybenzaldehyde and mixtures thereof.

9. The method according to claim 1, wherein the fragrance is obtainable from a plant source selected from the group consisting of pine, citrus, jasmine, patchouli, rose or ylang-ylang oil, clary sage oil, camomile oil, clove oil, balm oil, mint oil, cinnamon leaf oil, lime blossom oil, juniper berry oil, vetiver oil, olibanum oil, galbanum oil and labdanum oil, orange blossom oil, neroli oil, orange peel oil and sandalwood oil, angelica root oil, aniseed oil, arnica blossom oil, basil oil, bay oil, champaca flower oil, silver fir oil, silver fir cone oil, elemi oil, eucalyptus oil, fennel oil, pine needle oil, galbanum oil, geranium oil, gingergrass oil, guaiac wood oil, gurjan balsam oil, helichrysum oil, ho oil, ginger oil, iris oil, cajeput oil, sweet flag oil, camomile oil, camphor oil, cananga oil, cardamom oil, cassia oil, pine needle oil, copaiba balsam oil, coriander oil, spearmint oil, caraway oil, cumin oil, lavender oil, lemongrass oil, lime oil, mandarin oil, melissa oil, amber seed oil, myrrh oil, clove oil, neroli oil, niaouli oil, olibanum oil, oregano oil, palmarosa oil, patchouli oil, peru balsam oil, petitgrain oil, pepper oil, peppermint oil, pimento oil, pine oil, rose oil, rosemary oil, sandalwood oil, celery oil, spike oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, citrus oil and cypress oil.

10. The method of claim 2 wherein the prodrugs are of the general formula (III):

$$R—C(OR^1)(OR^2)—OR^3 \quad (III)$$

where R is hydrogen, linear $C_1$-$C_8$ alkyl, branched $C_3$-$C_{20}$ alkyl, cyclic $C_3$-$C_{20}$ alkyl, branched cyclic $C_6$-$C_{20}$ alkyl, linear $C_6$-$C_{20}$ alkenyl, branched $C_6$-$C_{20}$ alkenyl, cyclic $C_6$-$C_{20}$ alkenyl, branched cyclic $C_6$-$C_{20}$ alkenyl, substituted or unsubstituted $C_6$-$C_{20}$ aryl; and where $R^1$, $R^2$ and $R^3$ independently are linear, branched or substituted $C_1$-$C_{20}$ alkyl; linear, branched or substituted $C_2$-$C_{20}$ alkenyl; substituted or unsubstituted, cyclic $C_3$-$C_{20}$ alkyl; substituted or unsubstituted $C_6$-$C_{20}$ aryl, substituted or unsubstituted $C_2C_{40}$ alkyleneoxy; substituted or unsubstituted $C_3$-$C_{40}$ alkyleneoxyalkyl; substituted or unsubstituted $C_6$-$C_{40}$ alkylenearyl; substituted or unsubstituted $C_6C_{32}$ aryloxy; substituted or unsubstituted $C_6$-$C_{40}$ alkyleneoxyaryl; and, $C_6$-$C_{40}$ oxyalkylenearyl.

11. The method of claim 2 wherein the prodrugs are of the general formula (IV):

$$R—C(R^1)(OR^3)—OR^2 \quad (IV)$$

where R is linear $C_1$-$C_{20}$ alkyl, branched $C_3$-$C_{20}$ alkyl, cyclic $C_6$-$C_{20}$ alkyl, branched cyclic $C_6$-$C_{20}$ alkyl, linear $C_2$-$C_{20}$ alkenyl, branched $C_3$-$C_{20}$ alkenyl, cyclic $C_6$-$C_{20}$ alkenyl, branched cyclic $C_6$-$C_{20}$ alkenyl, substituted or unsubstituted $C_6$-$C_{20}$ aryl; where $R^1$ is hydrogen or R; and, where $R^2$ and $R^3$ are each independently selected from the group consisting of linear $C_1$-$C_{20}$ alkyl, branched $C_3$-$C_{20}$ alkyl, cyclic $C_3$-$C_{20}$ alkyl, branched cyclic $C_6$-$C_{20}$ alkyl, linear $C_6$-$C_{20}$ alkenyl, branched $C_6$-$C_{20}$ alkenyl, cyclic $C_6$-$C_{20}$ alkenyl, branched cyclic $C_6$-$C_{20}$ alkenyl, $C_6$-$C_{20}$ aryl, and substituted $C_7$-$C_{20}$ aryl.

12. The method of claim 2 wherein the prodrugs are of the general formula (V):

$$R^4O—C(OR^1)(OR^3)—OR^2 \quad (V)$$

where $R^1$, $R^2$, $R^3$ and $R^4$ are each independently linear, branched or substituted $C_1$-$C_{20}$ alkyl; linear, branched or substituted $C_2$-$C_{20}$ alkenyl; substituted or unsubstituted, cyclic $C_5$-$C_{20}$ alkyl; substituted or unsubstituted $C_6$-$C_{20}$ aryl, substituted or unsubstituted $C_2$-$C_{40}$ alkyleneoxy; substituted or unsubstituted $C_3$-$C_{40}$ alkyleneoxyalkyl; substituted or unsubstituted $C_6$-$C_{40}$ alkylenearyl; substituted or unsubstituted $C_6$-$C_{32}$ aryloxy; substituted or unsubstituted $C_6$-$C_{40}$ alkyleneoxyaryl; and, $C_6$-$C_{40}$ oxyalkylenearyl.

13. The method of claim 2 wherein the prodrugs are of the general formula (VI):

$$R—(—O—Si(OR)_2—)_n—OR \quad (VI)$$

where each R is independently selected from the group containing H, the straight-chain or branched, saturated or unsaturated, substituted or unsubstituted $C_1$-$C_6$ hydrocarbon radicals and the fragrance alcohol radicals and/or biocide alcohol radicals, and m adopts values from the range from 1 to 20 and n adopts values from the range from 2 to 100.

14. The method of claim 2 wherein the prodrugs are reaction products of compounds comprising at least one primary and/or secondary amine group.

15. The method of claim 14 wherein the reaction product of compounds comprising at least one primary and/or secondary amine group is an amino-functional polymer.

16. The method of claim 15 wherein the amino-functional polymer is an amino-functional silicone.

* * * * *